US006791523B2

(12) United States Patent
Fujita et al.

(10) Patent No.: US 6,791,523 B2
(45) Date of Patent: Sep. 14, 2004

(54) ELECTRO-OPTICAL PANEL, METHOD FOR DRIVING THE SAME, ELECTRO-OPTICAL DEVICE, AND ELECTRONIC EQUIPMENT

(75) Inventors: Shin Fujita, Suwa (JP); Tokuro Ozawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 211 days.

(21) Appl. No.: 09/910,879

(22) Filed: Jul. 24, 2001

(65) Prior Publication Data

US 2002/0015031 A1 Feb. 7, 2002

(30) Foreign Application Priority Data

Jul. 24, 2000 (JP) ..... 2000-222573
Nov. 27, 2000 (JP) ..... 2000-359881

(51) Int. Cl.[7] ..... G09G 3/36
(52) U.S. Cl. ..... 345/92; 345/100
(58) Field of Search ..... 345/94, 100, 87, 345/92

(56) References Cited

U.S. PATENT DOCUMENTS 4,870,396 A * 9/1989 Shields ..... 345/90
5,777,591 A * 7/1998 Katoh et al. ..... 345/92
5,844,535 A * 12/1998 Itoh et al. ..... 345/92
5,844,538 A * 12/1998 Shiraki et al. ..... 345/98
5,926,158 A * 7/1999 Yoneda et al. ..... 345/90
6,008,801 A * 12/1999 Jeong ..... 345/204
6,181,311 B1 * 1/2001 Hashimoto ..... 345/98
6,266,038 B1 * 7/2001 Yoshida et al. ..... 345/92
6,452,579 B1 * 9/2002 Itoh et al. ..... 345/100

FOREIGN PATENT DOCUMENTS

JP A 5-286935 11/1993
JP A 09-288261 11/1997
JP A 10-96754 4/1998

* cited by examiner

*Primary Examiner*—Xiao Wu
*Assistant Examiner*—Kevin M. Nguyen
(74) *Attorney, Agent, or Firm*—Oliff & Berridge, PLC

(57) ABSTRACT

To maintain image quality when a field frequency is dynamically changed. In an image display area AA, control lines 4*a* are arranged respectively corresponding to scanning lines 3*a*, and TFTs 50 and 51, a pixel electrode 9*a*, and a storage capacitor 52 are arranged at each intersection of one of data lines 6*a* and scanning lines 3*a*. A control signal SC supplied through the control line 4*a* controls the TFT 51 for an on and off operation. A timing signal generator circuit 300 activates the control signal SC when a field frequency is not higher than 60 Hz, and deactivates the control signal SC when a field frequency is above 60 Hz. In this way, whether or not to connect the storage capacitor 52 to the pixel electrode 9*a* is determined.

11 Claims, 16 Drawing Sheets

| Y1 | SC | SW | SC1 |
|---|---|---|---|
| L | L | OFF | HOLD |
| L | H | OFF | HOLD |
| H | L | ON | H |
| H | H | ON | L |

FIG. 11

ELECTRO-OPTICAL PANEL, METHOD FOR DRIVING THE SAME, ELECTRO-OPTICAL DEVICE, AND ELECTRONIC EQUIPMENT

BACKGROUND OF THE INVENTION

1. Field of Invention

The invention relates to an electro-optical panel, a method for driving the electro-optical panel, an electro-optical device including the electro-optical panel, and electronic equipment including the electro-optical panel.

2. Description of Related Art

Conventional electro-optical devices, such as active-matrix liquid-crystal display panels, typically include an element substrate, a counter substrate opposed to the element substrate, and a liquid crystal interposed between the two substrates. The element substrate typically includes a plurality of data lines, a plurality of scanning lines, a matrix of pixel electrodes at locations corresponding to the intersections of the data lines and the scanning lines, and thin-film transistors (hereinafter referred to as TFTs) respectively arranged for the pixel electrodes. Typically, the counter substrate includes a counter electrode and a color filter.

FIG. 18 shows an equivalent circuit of a pixel used in a conventional electro-optical panel. As shown, the pixel includes a TFT 1, a capacitor 2 of the liquid crystal and a storage capacitor 3. Both capacitors 2 and 3 are connected to a drain electrode of the TFT 1. The TFT 1 is configured with the gate electrode thereof being connected to a scanning line 4 and with the source electrode thereof being connected to a data line 5. The liquid-crystal capacitor 2 is formed of the liquid crystal interposed between the pixel electrode and the counter electrode.

When a scanning signal (a selection voltage) is applied to the TFT 1 through the scanning line 4 in this circuit, the TFT 1 is turned on. When an image signal is applied to the pixel electrode through the data line 5 with the TFT 1 in a conductive state, a predetermined charge is stored in the liquid-crystal capacitor 2 between the pixel electrode and the common electrode. When the TFT 1 is turned off in response to a non-selective voltage applied subsequent to storage of the charge, the charge at the liquid-crystal capacitor 2 is maintained. When the amount of charge to be stored is controlled using the TFT 1, the liquid crystal varies the orientation state pixel by pixel, thereby displaying predetermined information.

Since an off resistance of the TFT 1 is finite, charge stored in the liquid-crystal capacitor 2 is gradually discharged with time. The storage capacitor 3 is arranged to increase a time constant of discharge. Charge storage characteristics of the liquid-crystal capacitor 2 are thus improved. As a result, a contrast ratio of the panel is improved, and vertical cross-talk is controlled.

SUMMARY OF THE INVENTION

Since the field frequency of the image signal is 60 Hz in a NTSC system, the electro-optical panel is typically driven at 60 Hz. Depending on applications, the electro-optical panel has a low field frequency, for example, as low as 15 Hz or 30 Hz, or a high frequency, for example, as high as 120 Hz or 240 Hz.

To write the voltage of the data line 5 to the above-referenced pixel, the TFT 1 is turned on during a selective period and the voltage of the data line 5 is written to the liquid-crystal capacitor capacitance 2 through a time constant determined by the liquid-crystal capacitor, the storage capacitor, and the on resistance of the TFT 1. With the storage capacitor 3 added to the liquid-crystal capacitor 2, write time required to write the voltage on the pixel is prolonged.

With the storage capacitor 3 added, the voltage of the data line 5 is not sufficiently written to the liquid-crystal capacitor 2 when the field frequency is high and the selective period is short. On the other hand, with the storage capacitor 3 not added, holding a write voltage is difficult when the field frequency is low with a long holding period.

In the conventional electro-optical panel, typically the storage capacitor is determined to be compatible with both the selective period and the holding period. Varying these periods in accordance with the field frequency has not been contemplated.

The invention has been developed in view of the above problem, and it is an object of the present invention to assure the writing of the voltage to the pixel and the holding of the written voltage at the pixel even if the selective period and the holding period are varied.

To achieve the above object, an electro-optical panel of one exemplary embodiment of the invention includes a first substrate having a plurality of scanning lines and a plurality of data lines formed thereon, a second substrate opposed to the first substrate, and an electro-optical material interposed between the first substrate and the second substrate. The first substrate includes a plurality of control lines respectively formed corresponding to the scanning lines. A first switching element, which is arranged at each intersection of one of the scanning lines and one of the data lines, is controlled for an on and off operation in response to a scanning signal supplied through the scanning line. The first switching element is connected between the data line and a pixel electrode. A second switching element, which is arranged at each intersection of one of the scanning lines and one of the data lines, is controlled for an on and off operation in response to a control signal supplied through the control line. The second switching element is connected between the pixel electrode and a storage capacitor.

The electro-optical panel controls the second switching element in an on and off operation in response to the control signal, thereby connecting the storage capacitor to the pixel electrode or disconnecting the storage capacitor from the pixel electrode as necessary. An electro-optical material is switched based on whether or not the storage capacitor is connected to the electro-optical material capacitance format of the pixel electrode. A time constant involved in feeding a voltage from the data line to the pixel electrode through the first switching element is determined by an on resistance of the first switching element and the pixel capacitance value. A time constant involved in holding the voltage at the pixel is determined by the off resistance of the first switching element and the pixel capacitance value. The pixel capacitance value is modified depending on whether the storage capacitor is connected to the electro-optical material capacitance. By generating the control signal in accordance with the write period and the holding period, the voltage of the data line is reliably written on the pixel, and the voltage written on the pixel is reliably held. In this way, even if the field frequency is dynamically changed, high image quality is maintained.

Preferably, in another exemplary embodiment of the invention, an electro-optical panel further includes a first converter which converts input image data into point-at-a-time image data, a second converter which converts the point-at-a-time image data into line-at-a-time image data, a data line signal supplier which supplies each data line with a data line signal that is generated in accordance with the line-at-a-time image data, and a scanning line driver which generates a scanning signal for successively selecting the scanning lines and supplies the scanning lines with the scanning signal. Since the electro-optical panel includes the drivers for driving the data lines and the scanning lines, no driver circuits need to be arranged external to the electro-optical panel. A compact design is thus implemented in an apparatus that incorporates the electro-optical panel.

An electro-optical device according to another exemplary embodiment of the invention includes the above-referenced electro-optical panel and a control signal generator which generates the control signal in accordance with a field frequency. In this electro-optical device, the second switching element is controlled to disconnect the storage capacitor when the field frequency is high and the write period is short. When the field frequency is high and the holding period is long, the second switching element is controlled to connect the storage capacitor. In this way, even if the field frequency is dynamically changed, high image quality is maintained.

The control signal generator may generate the control signal respectively corresponding to each control line, and may supply the control line with the respective control signal. In this arrangement, whether the storage capacitor is connected is determined on a control line by control line basis, and more detailed control is performed. An electro-optical device of the invention may include the above-referenced electro-optical panel, and a control signal generator which generates the control signal depending on whether an image to be displayed is a moving picture or a still picture. In this electro-optical device, the second switching element is controlled so that the storage capacitor is disconnected when the image to be displayed is the moving picture. The second switching element is controlled so that the storage capacitor is connected when the image to be displayed is the still picture. In this way, even if the field frequency is dynamically changed, high image quality is maintained.

The invention according to another exemplary embodiment, relates to an electro-optical panel and includes a first substrate having a plurality of scanning lines and a plurality of data lines formed thereon, a second substrate opposed to the first substrate, and an electro-optical material interposed between the first substrate and the second substrate. The first substrate includes a plurality of control lines respectively formed corresponding to the scanning lines. The first substrate includes a first switching element arranged at each intersection of one of the scanning lines and one of the data lines. The first switching element is controlled for an on and off operation in response to a scanning signal supplied through the scanning line, and is connected between the data line and a pixel electrode. The first substrate also includes a second switching element arranged at each intersection of one of the scanning lines and one of the data lines. The second switching element is controlled for an on and off operation in response to a control signal supplied through the control line, and is connected between the pixel electrode and a storage capacitor. The first substrate includes a plurality of control circuits which generate the control signal, to be supplied to each control line, in accordance with the scanning signal and a common control signal indicating whether an image to be displayed is a moving picture or a still picture. Since the control signal is produced on a control line by control line basis (or on a scanning line by scanning line basis) in accordance with this invention, whether to connect the storage capacitor is controlled on a control line by control line basis.

Preferably, in one exemplary embodiment of the invention, during an active period of the scanning signal, the control circuit generates the control signal for turning off the second switching element when the common control signal indicates a moving picture, and generates the control signal for turning on the second switching element when the common control signal indicates a still picture. During a non-active period of the scanning signal, the control circuit generates the control signal for holding the state of the second switching element during the active period immediately prior to this non-active period of the scanning signal.

In one exemplary embodiment of the invention, the electro-optical panel preferably includes a scanning line driver which generates the scanning signal for successively selecting the scanning lines and supplies the scanning lines with the scanning signal for only a period during which an enable signal supplied from outside remains active.

The first switching element and the second switching element are preferably thin-film transistors. The thin-film transistors are advantageously formed on a glass substrate, or other substrates.

The invention according to another exemplary embodiment relates, to an electro-optical device which switches between a moving picture and a still picture on a field by field basis, and includes the above-referenced electro-optical device. The electro-optical device also includes a common control signal generator which generates the common control signal which is a binary signal which transitions in level on a field by field basis for indicating a moving picture thereof with one signal level and a still picture with the other signal level thereof, depending on whether an image to be displayed is the moving picture or the still picture. Further included in the electro-optical device is an enable signal generator which generates the enable signal that alternates between an active period and a non-active period with a constant period wherein the enable signal is active during a moving picture display period, while, during a still picture display period, the enable signal is active in a first field and becomes non-active in one field or a plurality of fields subsequent to the first field.

In accordance with one exemplary embodiment of the invention, voltage writing and voltage holding are performed on a field by field basis during the moving picture display period. During the sill picture display period, the electro-optical panel is driven with a period equal to a combination of the write period of one field and the holding period of a plurality of fields. During the still picture display period, the ratio of voltage writing is reduced, leading to a reduction in power consumption.

Preferably, in one exemplary embodiment of the invention, the common control signal generator transitions the signal level of the common control signal within a vertical blanking period, and the enable signal generator switches between the active period and the non-active period in the enable signal within the vertical blanking period. The image quality is thus improved, because no scanning lines are selected during the vertical blanking period.

The invention, according to another exemplary embodiment, relates to an electro-optical device which switches between a moving picture and a still picture on a scanning line by scanning line basis. The electro-optical device according to this embodiment includes the above-referenced electro-optical device. The electro-optical device according to this embodiment also includes a common control signal generator which generates the common control signal which is a binary signal which transitions in level for indicating a moving picture with one signal level thereof and a still picture with the other signal level thereof, depending on whether a moving picture display area is scanned during a moving picture display period or a still picture display area is scanned during a still picture display period. The electro-optical device according to this embodiment further includes an enable signal generator which generates the enable signal that alternates between an active period and a non-active period with a constant period wherein the enable signal is active during the moving picture display period in each field, while, during the still picture display period, the enable signal is active in a first field and becomes non-active in one field or a plurality of fields subsequent to the first field.

In one exemplary embodiment of the invention, when an area of the display screen presents a moving picture while the remaining area of the display screen presents a still picture, the storage capacitor is disconnected in the moving picture display area while the storage capacitor is connected in the still picture display area. Since the enable signal remains active in the moving picture display area, the voltage of the data line is written on the capacitance of the electro-optical material by successively selecting the scanning lines. In the still picture display area, the enable signal remains active with a constant period, and voltage writing is performed during the first field. Voltage holding is then performed during fields subsequent to the first field. During the still picture display period, the ratio of voltage writing is reduced, leading to a reduction in power consumption.

Preferably, according to one exemplary embodiment of the invention, the common control signal generator transitions the signal level of the common control signal within one of a vertical blanking period and a horizontal blanking period, and the enable signal generator switches between the active period and the non-active period in the enable signal during one of the vertical blanking period and during the horizontal blanking period.

The image quality is improved, because no scanning lines are selected during the vertical blanking period and during the horizontal blanking period.

The invention, according to one exemplary embodiment relates, to a driving method for displaying an image on an electro-optical panel which includes a plurality of scanning lines, a plurality of data lines, and a matrix of first capacitors and second capacitors. Each of the first and second capacitors are arranged at an intersection of one of the scanning lines and one of the data lines. The driving method includes the steps of determining whether a field frequency of an image to be displayed is higher or lower than a predetermined frequency, writing the voltage of the data line to the first capacitor by successively selecting the scanning lines with the first capacitor disconnected from the second capacitor, when the field frequency is higher than the predetermined frequency, and writing the voltage of the data line to the first capacitor and the second capacitor by successively selecting the scanning lines with the first capacitor connected to the second capacitor, when the field frequency is lower than the predetermined frequency. In accordance with the invention according to one exemplary embodiment, whether to connect the first capacitor to the second capacitor is determined depending on the field frequency. In this way, even if the field frequency is dynamically changed, high image quality is maintained.

The invention, according to one exemplary embodiment, relates to a driving method for displaying an image on an electro-optical panel which includes a plurality of scanning lines, a plurality of data lines, and a matrix of first capacitors and second capacitors. Each of the first and second capacitors are arranged at an intersection of one of the scanning lines and one of the data lines. The driving method includes the steps of determining whether an image to be displayed is a moving picture or a still picture, writing the voltage of the data line to the first capacitor by successively selecting the scanning lines with the first capacitor disconnected from the second capacitor, when the image to be displayed is the moving picture, and writing the voltage of the data line to the first capacitor and the second capacitor by successively selecting the scanning lines with the first capacitor connected to the second capacitor, when the image to be displayed is the still picture.

In accordance with the invention, according to one exemplary embodiment, whether to connect the first capacitor to the second capacitor is determined depending on whether the image to be displayed is a moving picture or a still picture. High image quality is thus maintained even when the moving picture and the still picture are switched one from the other.

The invention, according to one exemplary embodiment, relates to a driving method for displaying an image on an electro-optical panel with a moving picture and a still picture alternating with each other on a field by field basis. The electro-optical panel includes a plurality of scanning lines, a plurality of data lines, and a matrix of first capacitors and second capacitors. Each of the first and second capacitors are arranged at an intersection of one of the scanning lines and one of the data lines. The driving method includes the steps of writing the voltage of the data line to the first capacitor by successively selecting the scanning lines with the first capacitor disconnected from the second capacitor in each field in which the moving picture is displayed, writing the voltage of the data line to the first capacitor and the second capacitor by successively selecting the scanning lines with the first capacitor connected to the second capacitor in a first field of fields in which the still picture is displayed, holding the voltage written on the first capacitor and the second capacitor with the scanning lines not selected in one field or a plurality of fields subsequent to the first field, and repeating the writing steps and the holding step with a constant period.

In accordance with one exemplary embodiment of the invention, whether to connect the first capacitor to the second capacitor is determined depending on whether the image to be displayed is a moving picture or a still picture. High image quality is thus maintained even when the moving picture and the still picture are switched one from the other on a field by field basis.

The invention, according to one exemplary embodiment of the invention, relates to a driving method for displaying an image on an electro-optical panel with a moving picture and a still picture alternating with each other on a per scanning line basis. The electro-optical panel includes a plurality of scanning lines, a plurality of data lines, and a matrix of first capacitors and second capacitors. Each of the first and second capacitors are arranged at an intersection of one of the scanning lines and one of the data lines. The driving method includes the steps of writing the voltage of the data line to the first capacitor by successively selecting the scanning lines with the first capacitor disconnected from the second capacitor in each scanning line in which a moving picture is displayed, writing the voltage of the data line to the first capacitor and the second capacitor by successively selecting the scanning lines with the first capacitor connected to the second capacitor in a first field in each scanning line in which a still picture is displayed, holding the voltage written on the first capacitor and the second capacitor with the scanning lines not selected in one field or a plurality of fields subsequent to the first field, and repeating the writing steps and the holding step with a constant period.

In one exemplary embodiment of the invention, when an area of the display screen presents a moving picture while the remaining area of the display screen presents a still picture, the second capacitor is disconnected in the moving picture display area while the second capacitor is connected in the still picture display area. Since the enable signal always remains active in the moving picture display area, the voltage of the data line is written on the first capacitor by successively selecting the scanning lines. In the still picture display area, the enable signal remains active with a constant period, and voltage writing is performed during the first field, and voltage holding is then performed during fields subsequent to the first field. During the still picture display period, the ratio of voltage writing is reduced, leading to a reduction in power consumption.

Electronic equipment of the present invention includes the above-referenced electro-optical device, and may be a view finder of a video camera, a mobile telephone, a notebook computer, a video projector, etc.

BRIEF DESCRIPTION OF THE DRAWINGS

FIG. 11 is a truth table explaining operation of the control circuit;

DETAILED DESCRIPTION OF PREFERRED EMBODIMENTS

Figure 1:
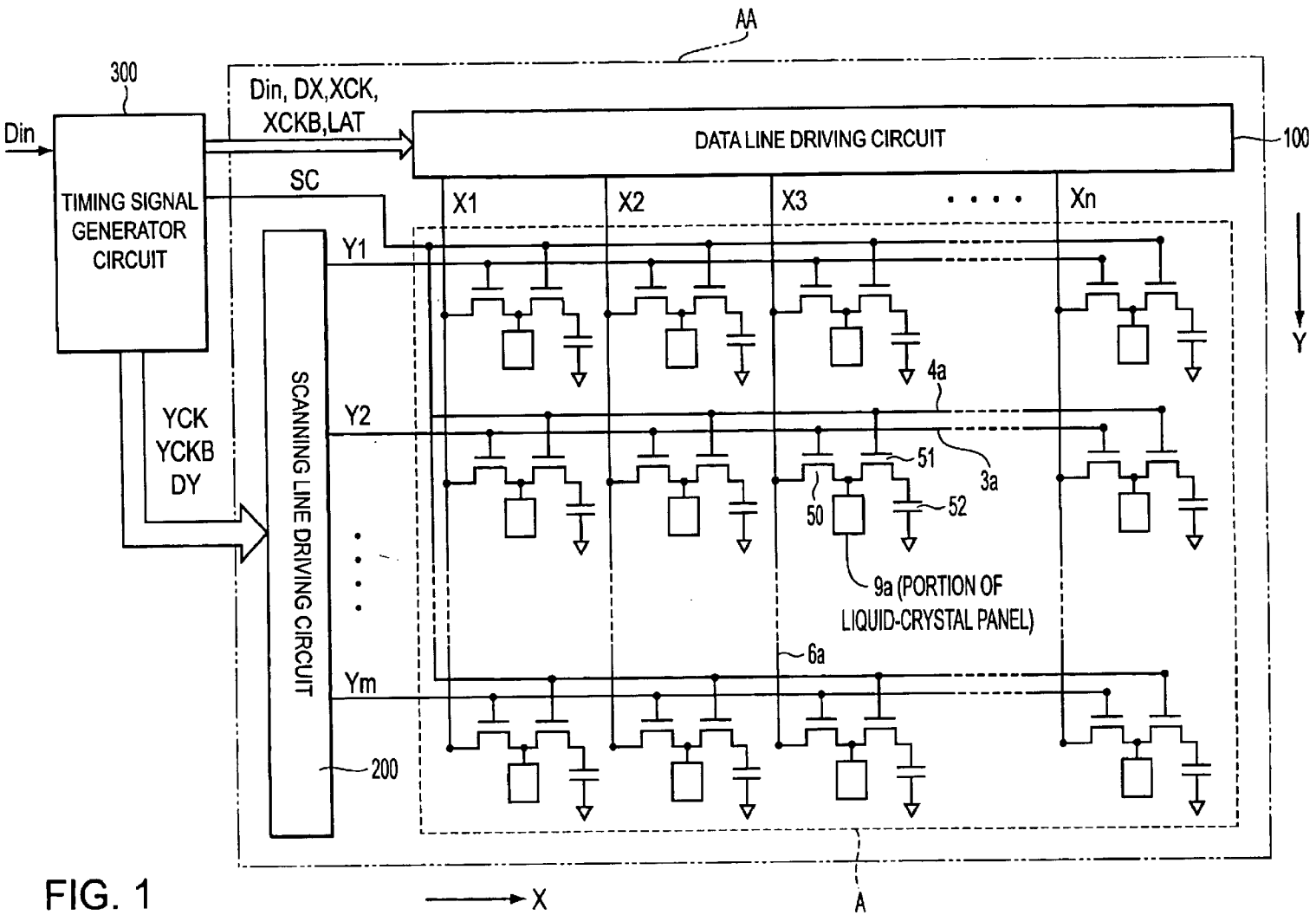
FIG. 1 is a block diagram showing the general construction of the liquid-crystal device of a first embodiment of the invention.

The embodiments of the invention are now discussed, referring to the drawings.

<1. First Embodiment>

<1-1: General Construction of the Liquid-Crystal Device>

A liquid-crystal device using a liquid crystal as an electro-optical material will now be discussed as an electro-optical device of the invention. As will be discussed later, a major portion of the liquid-crystal device includes an element substrate having TFTs as a switching element and a counter substrate, mutually opposed to each other with electrode bearing surfaces thereof facing each other. The two substrates are bonded to each other with a constant gap maintained therebetween, and a liquid crystal is interposed therebetween. A liquid-crystal panel AA is thus constructed.

FIG. 1 is a block diagram showing the general construction of the liquid-crystal device of a first embodiment of the invention. The liquid-crystal device includes an image display area A, a data line driving circuit 100, and a scanning line driving circuit 200 on the element substrate of a liquid-crystal panel AA. The liquid-crystal panel AA includes a timing signal generator circuit 300 as a processing circuit external to the liquid-crystal panel AA.

Input image data Din is supplied to the liquid-crystal device in three-bit parallel format. For simplicity of explanation, the input image data Din is discussed as being for a single color. The invention is not limited to this, and the input image data Din may be for the three primary RGB colors.

In synchronization with the input image data Din, the timing signal generator circuit 300 generates a Y clock signal YCK, an inverted Y clock signal YCKB, an X clock signal XCK, an inverted X clock signal XCKB, a Y shift pulse DY, an X shift pulse DX, a latch pulse LAT, etc., and feeds these signals to the data line driving circuit 100 and the scanning line driving circuit 200.

The timing signal generator circuit 300 generates a control signal SC for controlling the connection and disconnection of a storage capacitor 52, to be discussed later, to and from a pixel electrode 9*a* (a liquid crystal LC), and outputs the control signal SC to the image display area A. Specifically, the timing signal generator circuit 300 detects the field frequency of a driving method, compares the detected field frequency with a predetermined reference frequency, and then generates the control signal SC based on a comparison result. In this embodiment, the reference frequency is 60 Hz. When the field frequency is not higher than 60 Hz, the timing signal generator circuit 300 generates a high-level control signal SC for connecting the storage capacitor 52 to the pixel electrode 9*a*. When the field frequency is higher than 60 Hz, the timing signal generator circuit 300 generates a low-level control signal SC for disconnecting the storage capacitor 52 from the pixel electrode 9*a*. The field frequency is 1/Tx, where Tx is one period required to successively select all scanning lines in this embodiment.

<1-2: Image Display Area>

The image display area A is formed of m scanning lines 3*a* and m control lines 4*a*, running in parallel in the X direction, and n data lines 6*a* running in parallel in the Y direction as shown in FIG. 1. In the vicinity of an intersection of one of the scanning lines 3*a* and one of the data lines 6*a,* a TFT 50 is configured with the gate electrode thereof connected to the scanning line 3*a,* with the source electrode thereof connected to the data line 6*a,* and with the drain electrode thereof connected to the pixel electrode 9*a*. A TFT 51 is configured with the gate electrode thereof connected to a control line 4*a,* with the source electrode thereof connected to the pixel electrode 9*a,* and with the drain electrode thereof connected to the storage capacitor 52.

Each pixel is formed of the TFTs 50 and 51, the storage capacitor 52, and a liquid-crystal capacitor LC. The liquid-crystal capacitor LC is formed of the pixel electrode 9*a,* a counter electrode (to be discussed later) formed on a counter substrate, and a liquid crystal interposed between the two electrodes. As a result, a matrix of pixels are arranged at locations corresponding to the intersections of the scanning lines 3*a* and the data lines 6*a*. The TFTs 50 and 51, which are of an N-channel transistor, are turned on when the gate voltage is at a high level and turned off when the gate voltage is at a low level. By controlling the gate voltage of the TFT 50, the data line signal supplied to the data line 6*a* is written to the liquid-crystal capacitor LC. By controlling the gate voltage of the TFT 51, the connection of the storage capacitor 52 to the liquid-crystal capacitor LC is controlled.

The scanning lines 3*a* connected to the gates of the respective TFTs 50 are successively applied with scanning signals Y1, Y2, . . . , Ym in the form of a pulse on a line at a time basis. When the scanning lines 3*a* are supplied with the scanning signals, the TFTs 50 connected to the corresponding scanning line 3*a* are turned on. Data line signals X1, X2, . . . , Xn supplied to the data lines 6*a* at predetermined timings are successively written on the corresponding pixels and are held for a predetermined period.

Since the orientation or order of liquid crystal molecules changes in accordance with a voltage level applied to each pixel, the liquid crystal presents a gradation display through light modulation. In the normally white mode, the quantity of light transmitted through the liquid crystal is limited as the applied voltage rises, while in the normally black mode, the quantity of light transmitted through the liquid crystal is increased as the applied voltage rises. The liquid-crystal display device outputs light, having a contrast responsive to the gradation to be displayed, from each pixel. The liquid-crystal device thus presents a desired display.

The control signal SC supplied to the control line 4*a* is at a high level when the field frequency is not higher than 60 Hz, as already discussed. A low field frequency thus causes the TFT 51 to be turned on, thereby connecting the storage capacitor 52 in parallel with the liquid-crystal capacitor LC. On the other hand, when the field frequency is higher than 60 Hz, the control signal SC is driven at a low level. A high field frequency thus causes the TFT 51 to be turned off, thereby disconnecting the storage capacitor 52 from the liquid-crystal capacitor LC.

When the field frequency is low, a pixel capacitance value Cg is considered to be a sum of the capacitance value CLC of the liquid-crystal capacitor LC and the capacitance value CST of the storage capacitor. The write time required to write the data signal to the pixel is thus prolonged, while storage characteristics for holding the voltage at the pixel are improved. The pixel capacitance value Cg when the field frequency is high coincides with the liquid-crystal capacitance value CLC. In this way, the write time required to write the data signal to the pixel is shortened. In this case, although the storage characteristics of the liquid-crystal capacitor LC are degraded, the hold time with a high field frequency is shortened. Variations in the voltage of the liquid-crystal capacitor LC are small enough to be neglected in practice.

<1-3: Data Line Driving Circuit>

Figure 2:
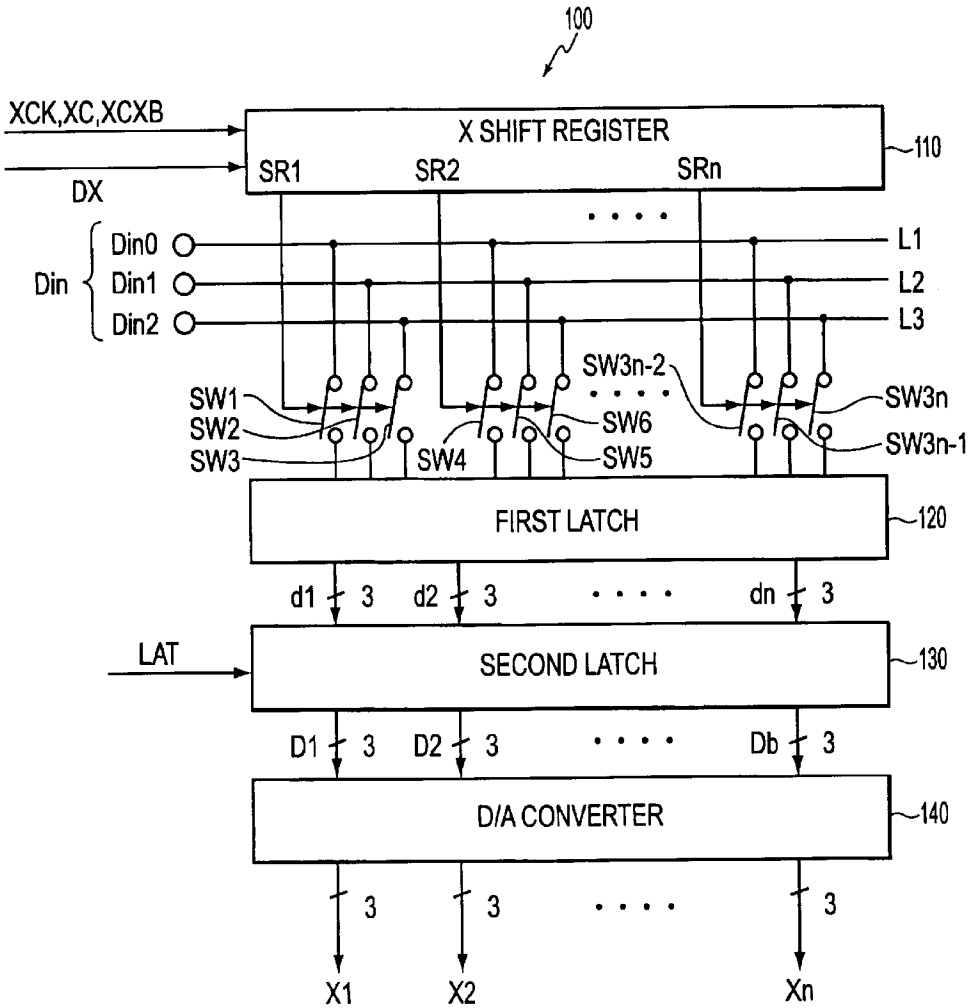
FIG. 2 is a block diagram showing the construction of the data line driving circuit of the liquid-crystal device.

Referring to FIG. 2, the data line driving circuit 100 includes an X shift register 110, image data supply lines L1–L3 to which input image data Din0–Din2 are fed, switches SW1–SW3n, a first latch 120, a second latch 130, and a D/A converter 140.

The X shift register 110 successively shifts the X shift pulse DX in response to the X clock signal XCK and the inverted X clock signal XCKB, thereby successively generating sampling pulses SR1, SR2, . . . , SRn.

The image data supply lines L1–L3 are connected to the first latch 120 through the switches SW1–SW3n, and the switches SW1–SW3n receive, at the respective control inputs thereof, the sampling pulses SR1, SR2, . . . , SRn. The switches SW1–SW3n are grouped into sets, each set composed of three switches corresponding to the input image data Din0–Din2. The image data Din0–Din2 are concurrently fed to the first latch 120 respectively in synchronization with the sampling pulses SR1, SR2, . . . , SRn.

The first latch 120 latches the input image data Din0–Din2 supplied through the switches SW1–SW3n. In this way, point-at-a-time data d1–dn, which is scanned on a point at a time basis, is obtained. The second latch 130 latches the point-at-a-time data d1–dn in response to a latch pulse LAT. The latch pulse LAT remains active during every horizontal scanning period. The second latch 130 aligns the point-at-a-time data d1–dn in phase, every horizontal scanning period, thereby producing line-at-a-time data D1–Dn.

The D/A converter 140 converts the three-bit digital line-at-a-time data D1–Dn into analog signals as data line signals X1–Xn, and feeds the data line signals X1–Xn to the data lines 6*a*. In other words, the D/A converter 140 functions as a data line signal supplier which feeds, to the data lines 6*a,* the data line signals X1–Xn which are generated from the line-at-a-time data D1–Dn.

<1-4: Construction of the Liquid-Crystal Panel>

Figure 3:
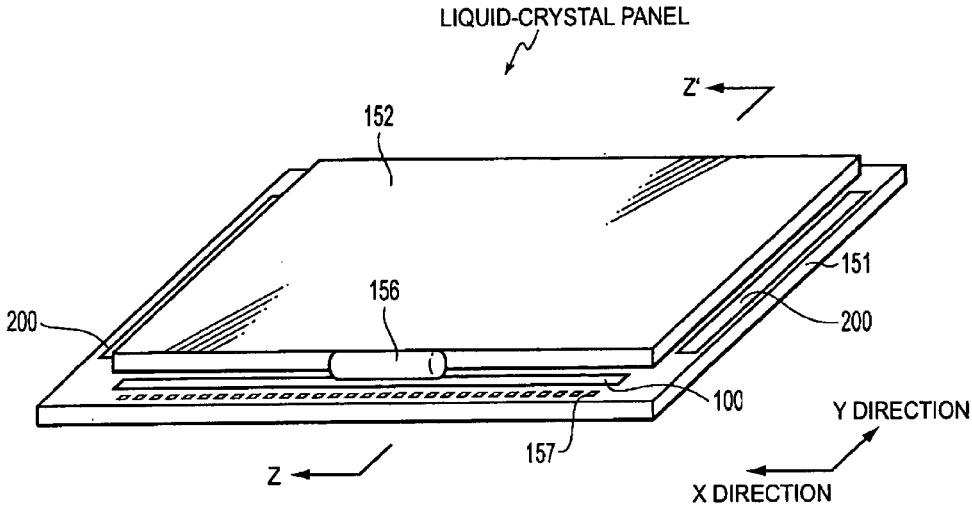
FIG. 3 is a perspective view showing the construction of the liquid-crystal panel of the liquid-crystal device.
Figure 4:
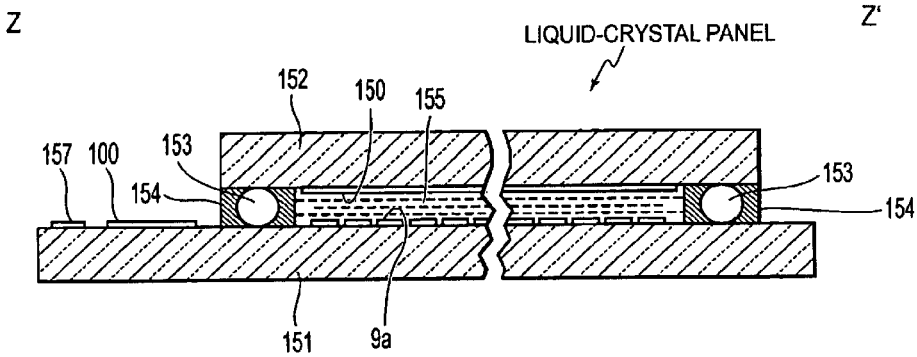
FIG. 4 is a cross-sectional view partly illustrating the structure of the liquid-crystal panel.

Referring FIG. 3 and FIG. 4, the electrical construction of the liquid-crystal panel AA is generally discussed. FIG. 3 is a perspective view showing the construction of the liquid-crystal panel AA, and FIG. 4 is a cross-sectional view taken along line Z–Z' in FIG. 3.

As shown, the liquid-crystal panel AA includes an element substrate 151, fabricated of glass, semiconductor, or the like, and having the pixel electrodes 9*a* formed thereon, and a transparent substrate 152, fabricated of glass, or the like, and having a common electrode 150 formed thereon. The element substrate 151 is bonded together with the transparent substrate 152 with a predetermined gap maintained therebetween by a sealing member 154 containing spacers 153 in a manner such that the electrode formation surfaces of the two substrates face each other. A liquid crystal 155 is encapsulated into the gap as an electro-optical material. The sealing member 154 is formed along the periphery of the transparent substrate 152, and has an opening through which the liquid crystal 155 is introduced. After the encapsulation of the liquid crystal 155, the opening is closed with a seal material 156.

A data line driving circuit 100 is arranged on one side of the element substrate 151 on the surface facing the transparent substrate 152, external to the area of the sealing material 154, and drives the data lines 6*a* running in the Y direction. A plurality of interconnect electrodes 157 are arranged on this side of the element substrate 151 and receive a variety of signals and image data D0–D2 from the timing signal generator circuit 300. A scanning line driving circuit 200 is arranged on one side next to the first side of the element substrate 151, and drives the scanning lines 3*a* running in the X direction.

The common electrode 150 of the transparent substrate 152 is electrically connected to the element substrate 151 through a conductive member arranged on at least one of the four corners of the bonding portion mating the element substrate 151. Furthermore, first, the transparent substrate 152 is provided with a color filter which has a striped, mosaic, or triangular pattern depending on applications of the liquid-crystal panel AA. Second, the transparent substrate 152 is provided with a black matrix, fabricated of a resin black, in which a metal, such as chromium or nickel, or carbon, or titanium is dispersed in a photoresist. Third, the transparent substrate 152 is provided with a back light for illuminating the liquid-crystal panel AA. In light modulation applications, the transparent substrate 152 is provided with a black matrix but with no color filter.

An alignment layer, which has been subjected to a rubbing process in a predetermined direction, is arranged on each of the mutually facing surfaces of the element substrate 151 and the transparent substrate 152. A polarizer (not shown), which is aligned in an alignment direction, is arranged on each of the outer surfaces of the element substrate 151 and the transparent substrate 152. If a polymer dispersed liquid crystal consisting of a mixture of fine particles of liquid crystal and polymer is used as the liquid crystal 155, the above-mentioned alignment layer and the polarizer are dispensed with. With a high utilization of light thus achieved, high light level and low power consumption features are incorporated.

A driver IC chip which is mounted on a film using a TAB (Tape Automated Bonding) technique may be electrically and mechanically connected through an anisotropically electrically conductive film arranged at a predetermined location of the element substrate 151, rather than mounting part of peripheral circuits such as the data line driving circuit 100 and the scanning line driving circuit 200 on the element substrate 151. Alternatively, the driver IC chip itself may be electrically and mechanically connected through an anisotropically electrically conductive film arranged at a predetermined location of the element substrate 151, using a COG (Chip On Glass) technique.

<1-5: Operation of the Liquid-Crystal Device>

Figure 5:
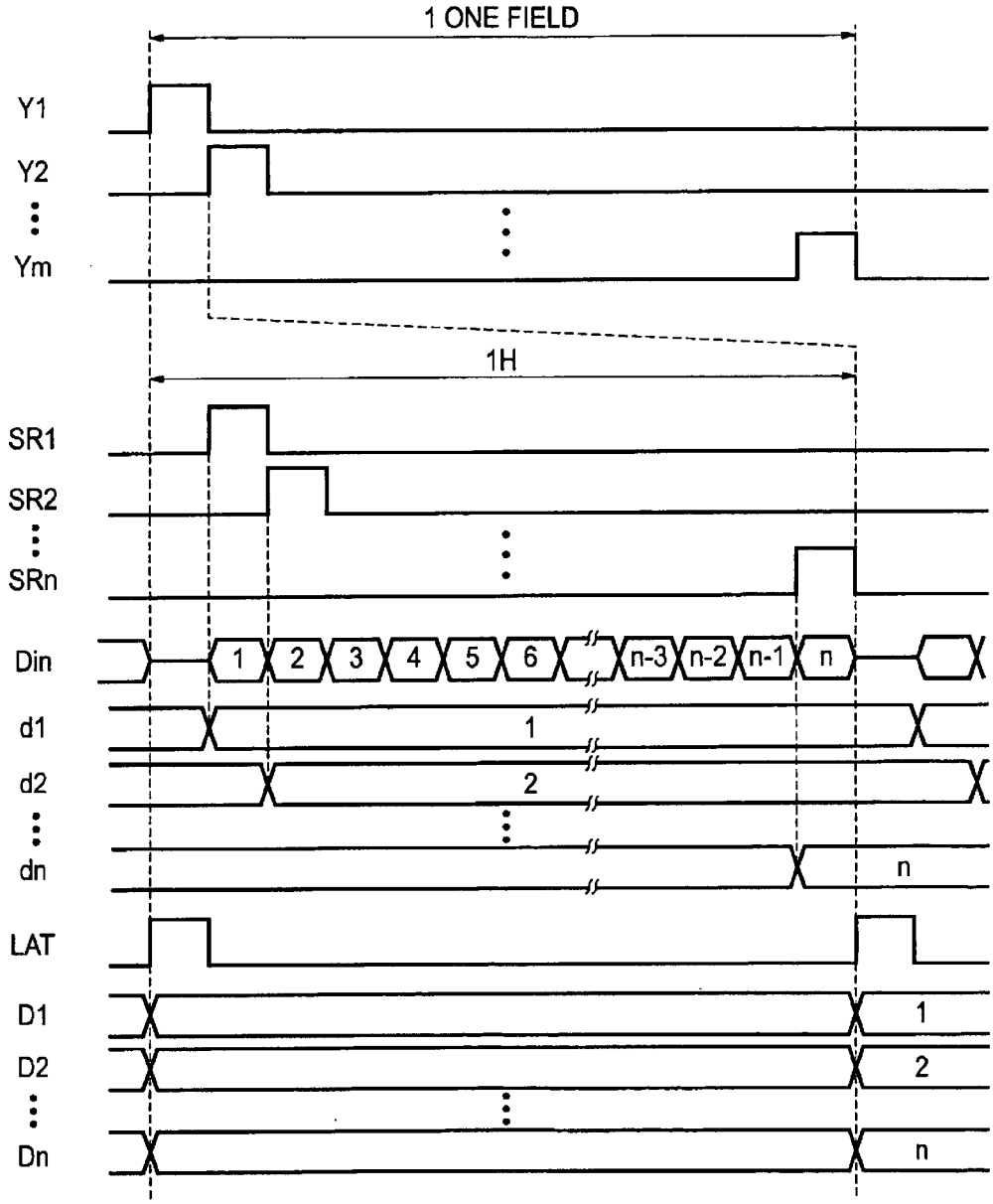
FIG. 5 is a timing diagram showing general operation of the liquid-crystal device.
Figure 6:
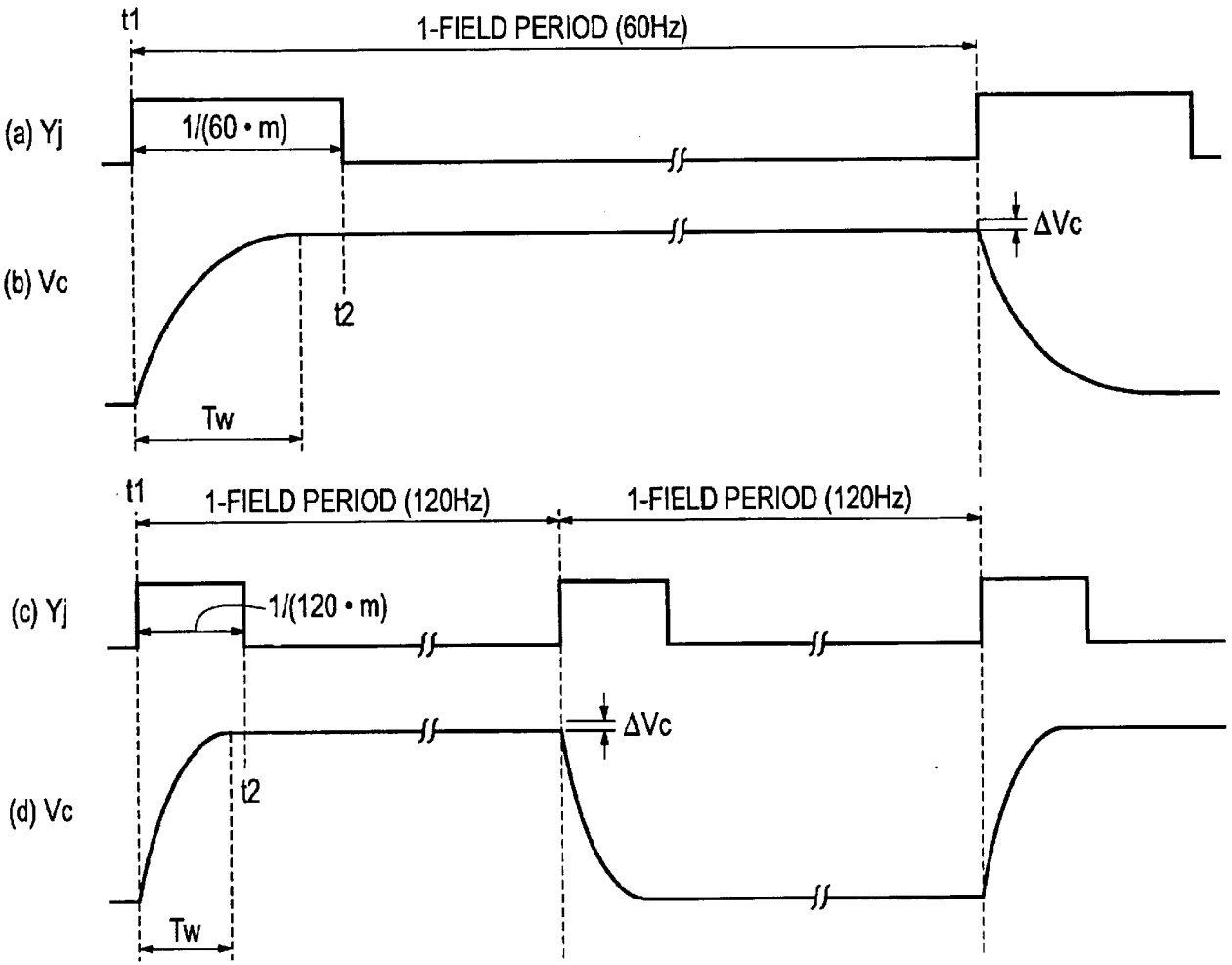
FIG. 6 is a timing diagram showing a write operation for writing data line signals to pixels.

Operation of the liquid-crystal device will now be discussed. FIG. 5 is a timing diagram showing the general operation of the liquid-crystal device, and FIG. 6 is a timing diagram showing the operation of writing a data line signal to a pixel. As shown, for simplicity of explanation, a vertical blanking period is not shown.

Upon receiving the Y shift pulse DY, the scanning line driving circuit 200 shifts the Y shift pulse DY in response to the Y clock signal YCK and the inverted Y clock signal YCKB, thereby generating the scanning signals Y1, Y2, . . . , Ym as shown in FIG. 5. The active period of each of the scanning signals Y1, Y2, . . . , Ym is one horizontal scanning period, and the active period is successively shifted. In this way, the scanning lines 3*a* are successively selected.

Upon receiving the X shift pulse DX, the data line driving circuit 100 successively shifts the X shift pulse DX, thereby generating the sampling pulses SR1, SR2, . . . , SRn as shown. In response to the sampling pulses SR1, SR2, . . . , SRn, the switches SW1–SWn sample the input image data Din, and the first latch 120 latches a sampling result. The point-at-a-time data d1–dn thus results as shown in FIG. 5.

In succession, the second latch 130 latches the point-at-a-time data d1, d2, . . . , dn at the start of one horizontal scanning period, thereby producing the line-at-a-time data D1, D2, . . . , Dn. The line-at-a-time data D1, D2, . . . , Dn is converted by the D/A converter 140 into data line signals X1, X2, . . . , Xn, which are then fed to the data lines 6*a*.

Since the total number of the scanning lines 3*a* is m, the active period of the scanning signal Yj is 1/(60 m) as shown in FIG. 6(*a*) when the field frequency is 60 Hz. In this case, the control signal SC is at a high level, and the TFT 51 in each pixel is turned on, thereby connecting the storage capacitor 52 to the liquid-crystal capacitor LC. The pixel capacitance value Cg equals CLC+CST, where CLC represents the liquid-crystal capacitance value and CST represents the storage capacitor value. Let Ron represent the on resistance of the TFT 50, and Roff represent the off resistance of the TFT 50, and a voltage Vc on the pixel electrode of the liquid-crystal capacitor LC gradually rises in accordance with a time constant of Ron(CLC+CST) from time t1 as shown in FIG. 6(*b*), and flattens off substantially at a constant value prior to time t2 at which the active period of the scanning signal Yj ends. At time t2, the scanning signal Yj is driven at a low level, turning off the TFT 51. The voltage Vc drops in accordance with a time constant Roff (CLC+CST). Since the storage capacitor 52 is connected with the liquid-crystal capacitance value CLC in this embodiment, the write time Tw to write the image signal on the liquid-crystal capacitor LC becomes relatively long. But a voltage variation DVc in the voltage Vc is reduced even if the holding period is long, because the discharge time constant Roff(CLC+CST) is large.

Now, the field frequency is switched from 60 Hz to 120 Hz. The active period of the scanning signal Yj becomes 1/(120 m) as shown in FIG. 6(*c*). The control signal SC is driven low in level, thereby turning off the TFT 51, and disconnecting the storage capacitor 52 from the liquid-crystal capacitor LC. The pixel capacitance value Cg becomes CLC. In this case, the voltage Vc at the pixel electrode of the liquid-crystal capacitor LC sharply rises in accordance with a time constant Ron×CLC from time t1 as shown in FIG. 6(*d*), and flattens off substantially at a constant value prior to time t2 at which the active period of the scanning signal Yj ends. The scanning signal Yj is driven low at time t2, thereby turning off the TFT 51. The voltage Vc drops in accordance with a time constant Roff×CLC. Since the storage capacitor 52 remains disconnected from the liquid-crystal capacitor LC in this case, the write time Tw to write the data line signal on the liquid-crystal capacitor LC becomes relatively short, and the discharge time constant Roff×CLC is small. A voltage variation DVc in the voltage Vc is small, because the hold time is as half as that in the field frequency of 60 Hz.

In accordance with this embodiment, connecting the storage capacitor to the liquid-crystal capacitor is controlled depending on the field frequency. When the field frequency is low, the voltage applied to the liquid crystal is maintained at an excellent level, and when the field frequency is high, the data line signal is written on the liquid crystal capacitor within a short period of time.

Images are thus displayed at a high image quality even if the field frequency varies.

<1-6: Modification of the First Embodiment>

<1-6-1: Method of Supplying the Control Signal>

In the above-referenced first embodiment, a common control signal SC is supplied to all control lines 4*a*. The invention is not limited to this arrangement. Alternatively, different control signals SC are respectively supplied to the control lines 4*a* to control the TFTs 51 for an on and off operation on a per horizontal scanning line basis. In this way, control of connecting the storage capacitor 52 to the liquid-crystal capacitor LC is performed on a per horizontal scanning line basis. In this case, however, m control signals SC need to be supplied to the control lines 4*a*. The m control signals SC may be produced by using the scanning signals Y1, Y2, . . . , Ym, or by separately arranging a control line driving circuit, like the scanning line driving circuit 200, including a shift register.

This modification is appropriate for use with a driving method, in which one field of the input image data Din is divided into a plurality of subfields depending on the weight of each bit and all scanning lines 3*a* are successively selected for each subfield. In this case, the time of each subfield varies in accordance with the weight of each bit. The field frequency is different from subfield to subfield. For a period during which the field frequency is low, the storage capacitor 52 is connected, while for a period during which the field frequency is high, the storage capacitor 52 is disconnected.

<1-6-2: Switching Between the Moving Picture and the Still Picture in Response to the Control Signal>

When the field frequency is equal to or lower than 60 Hz in the above-referenced first embodiment, the storage capacitor 52 is connected to the liquid-crystal capacitor LC with the control signal SC being at a high level. When the field frequency is higher than 60 Hz, the storage capacitor 52 is disconnected from the liquid-crystal capacitor LC with the control signal SC being at a low level. The signal level of the control signal SC may be switched, depending on whether an image to be displayed is a moving picture or a still picture.

In this case, a supply unit for supplying the input image data Din generates a switching signal indicating the type of display by detecting whether the image to be displayed is a moving picture or a still picture. The switching signal is then supplied to the timing signal generator circuit 300. In response to the switching signal, the timing signal generator circuit 300 generates the control signal SC. Alternatively, the timing signal generator circuit 300 determines whether the image is a moving picture or a still picture, based on the input image data Din, and generates the control signal SC based on a determination result. A known determination method may be used to detect whether the image is a moving picture or a still picture. For example, a correlation value indicating the degree of correlation between fields is detected and is compared with a threshold. When the degree of correlation is high, the device determines that the image is a still picture. When the degree of correlation is low, the device determines that the image is a moving picture.

When the control signal SC is transitioned in level, the storage capacitor 52 is connected or disconnected from the liquid-crystal capacitor LC, and the displayed image is thus affected. The signal level of the control signal SC is transitioned within a duration of time during which the displayed image is not affected. Specifically, the signal level of the control signal SC is transitioned within a vertical blanking period.

Figure 7:
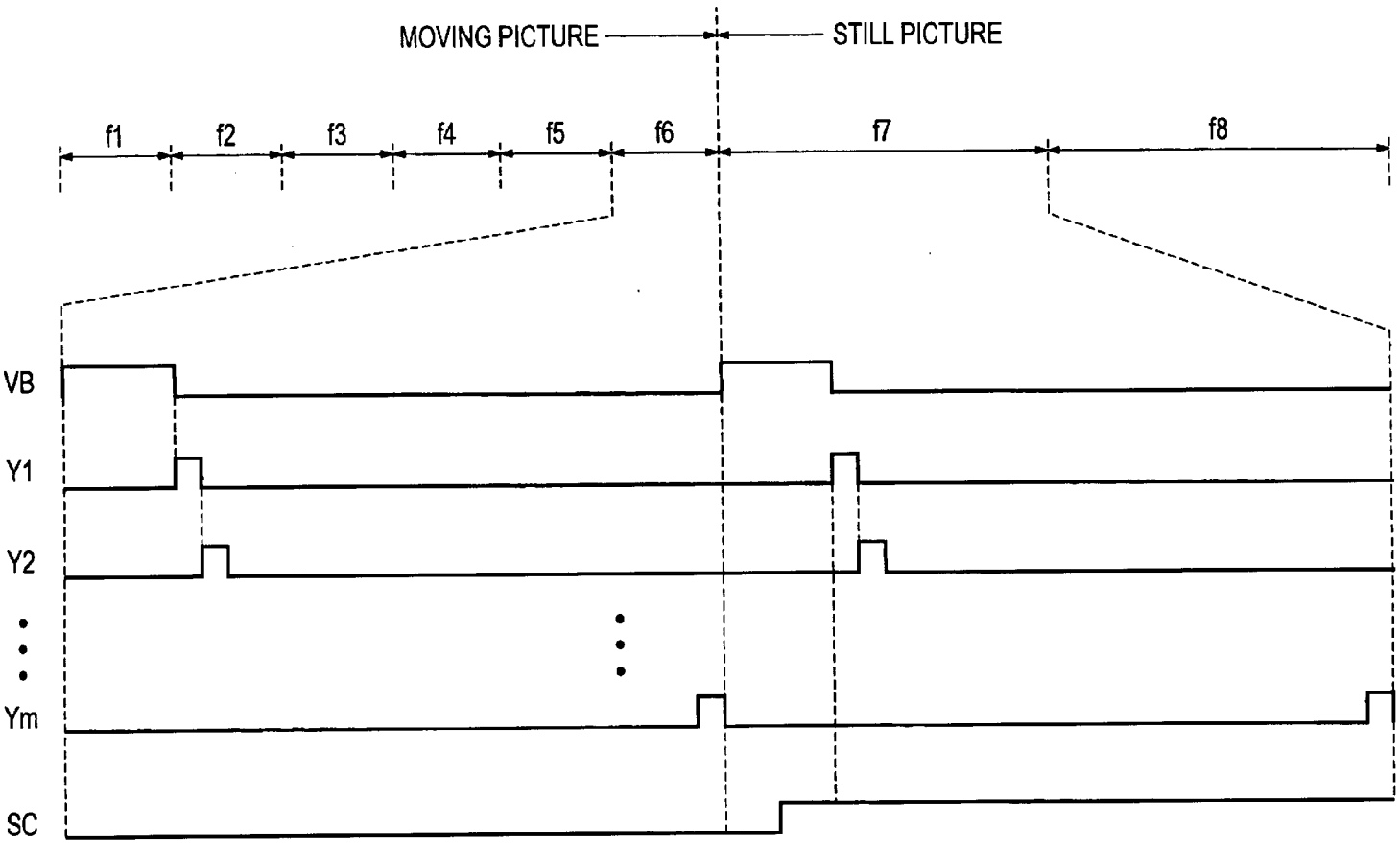
FIG. 7 is a timing diagram showing the switching timing of a control signal.

FIG. 7 is a timing diagram showing one example of switching timing of the control signal SC. In this example, a moving picture is presented from a first field f1 through a sixth field f6. A still picture is presented in a seventh field and subsequent fields. In this example, the moving picture is presented at a field frequency of 60 Hz, while the still picture is presented at a field frequency of 15 Hz. The high-level duration of the vertical blanking signal VB shown in FIG. 7 is the blanking period thereof. The vertical blanking signal VB is generated in the timing signal generator circuit 300, and is used to generate the Y shift pulse DY. The scanning signals Y1, Y2, . . . , Ym become active (to a high level) while the vertical blanking signal VB remains low. The control signal SC is transitioned from a low level to a high level within the vertical blanking period of the seventh field f7. In other words, the control signal SC is transitioned in level within a period during which the TFTs 50 of all pixels are turned off. While the data line signals X1, X2, . . . , Xn are written to the respective pixels, the control signal SC remains unchanged in level, and the connection and disconnection of the storage capacitor 52 to and from the liquid-crystal capacitor LC are not performed throughout this period. As a result, the data line signals X1, X2, . . . , Xn are reliably captured in the pixels. Image quality is not degraded at a switching timing at which the moving picture is switched to the still picture.

<2. Second Embodiment>

A second embodiment of the invention is now discussed, referring to the drawings.

<2-1: General Construction of the Liquid-Crystal Device>

Figure 8:
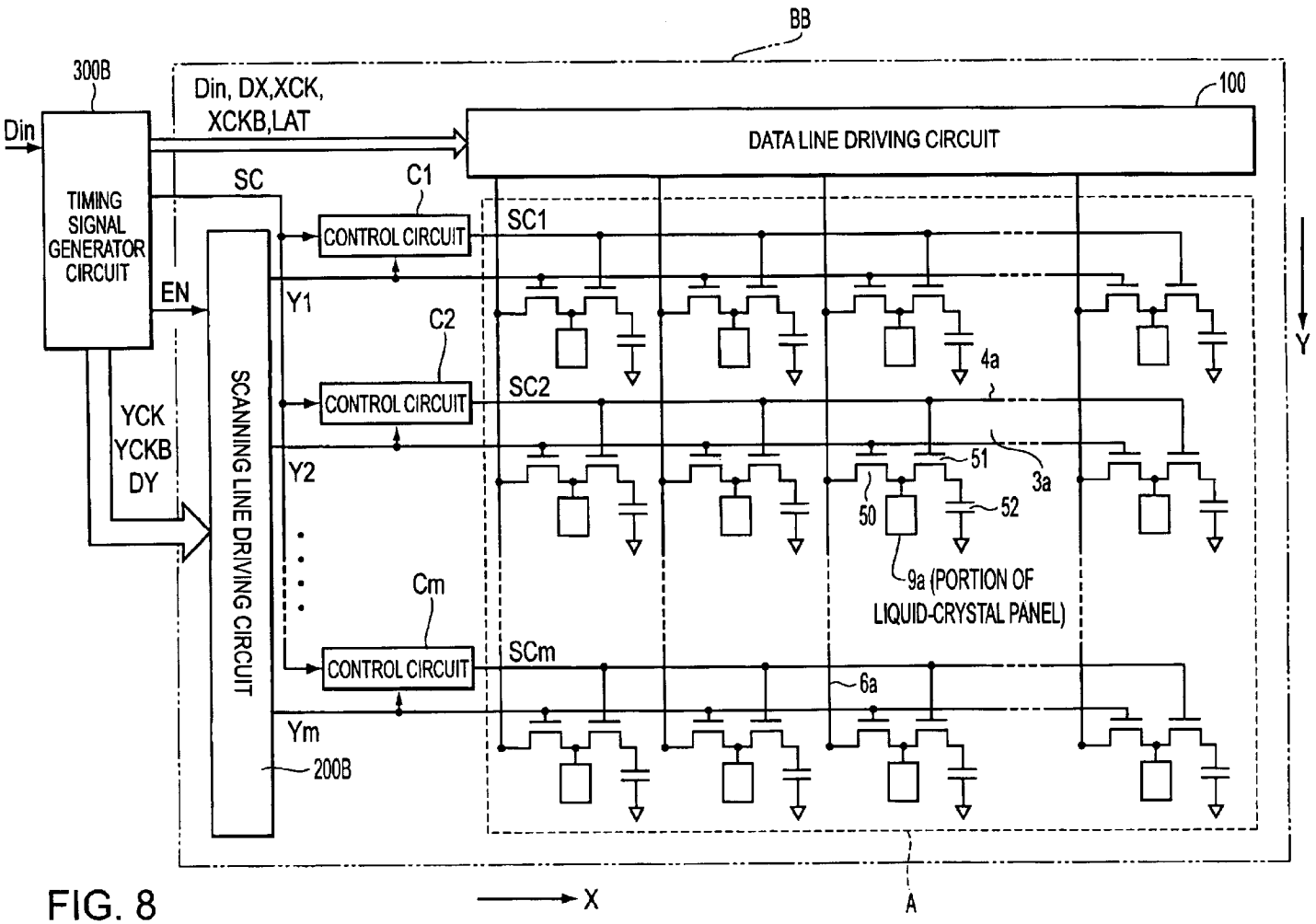
FIG. 8 is a block diagram showing the general construction of the liquid-crystal device of a second embodiment of the invention.

FIG. 8 is a block diagram showing the general construction of the liquid-crystal device of the second embodiment of the present invention. The liquid-crystal device of this embodiment remains unchanged from the liquid-crystal device of the first embodiment shown in FIG. 1 except that timing signal generator circuit 300B is substituted for timing signal generator circuit 300, scanning line driving circuit 200B is substituted for scanning line driving circuit 200 in liquid-crystal panel BB, and control circuits C1, C2, . . . , Cm are added.

The timing signal generator circuit 300B is identical to the timing signal generator circuit 300 in the first embodiment except that the timing signal generator circuit 300B generates an enable signal EN. The enable signal EN in the high level activates the scanning signals Y1, Y2, . . . , Ym while deactivating the scanning signals Y1, Y2, . . . , Ym in the low level.

<2-2: Scanning Line Driving Circuit>

Figure 9:
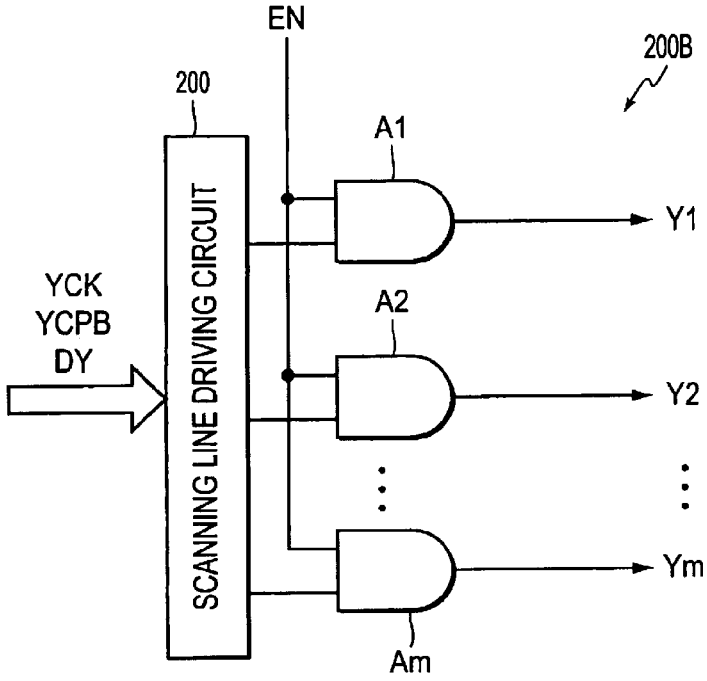
FIG. 9 is a block diagram of the scanning line driving circuit of the liquid-crystal device.

FIG. 9 is a block diagram showing the scanning line driving circuit 200B. As shown, the scanning line driving circuit 200B includes the scanning line driving circuit 200 in the first embodiment and AND gates A1, A2, . . . , Am. The AND gates A1, A2, . . . , Am receive respective output signals from the scanning line driving circuit 200 at input terminals thereof, while receiving the enable signal EN at other input terminals thereof. When the enable signal EN is at a high level, the scanning signals Y1, Y2, . . . , Ym agree with the respective outputs from the scanning line driving circuit 200. When the enable signal EN is at a low level, the scanning signals Y1, Y2, . . . , Ym are at a low level (a non-active level).

In the liquid-crystal device shown in FIG. 8, the control signal SC is not supplied to each control line 4*a*, but control circuits C1, C2, . . . , Cm respectively supply control signals SC1, SC2, . . . , SCm to the control lines. Control of connecting the storage capacitor 52 to the liquid-crystal capacitor LC is performed on a scanning line by scanning line basis. In the discussion that follows, the control signal SC is referred to as a common control signal SC to distinguish it from each of the scanning signals SC1, SC2, . . . , SCm.

<2-3: Control Circuit>

Figure 10:
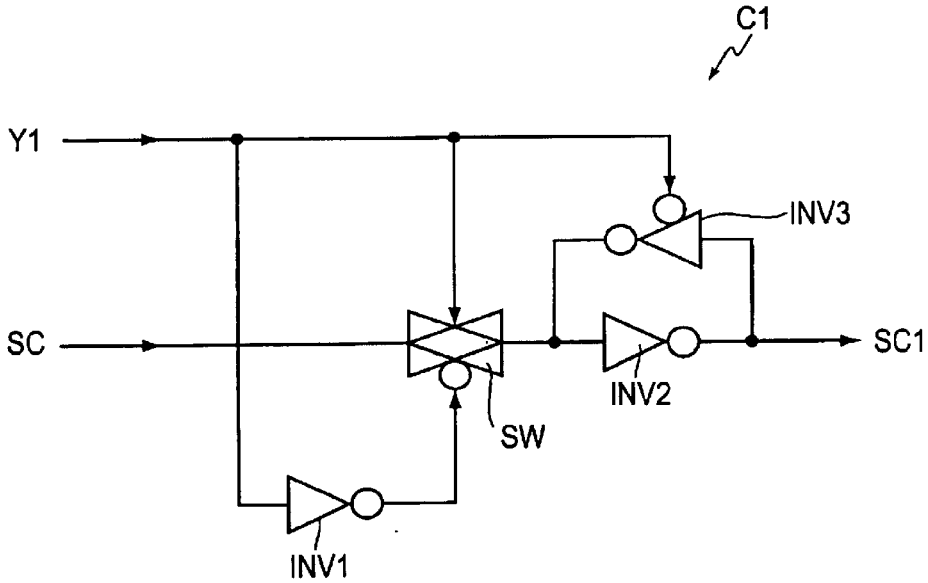
FIG. 10 is a circuit diagram of the control circuit used in the liquid-crystal device.

FIG. 10 is a circuit diagram showing the construction of the control circuit C1. The other control circuits C2–Cm have the same construction as that of the control circuit C1. As shown, the control circuit C1 includes inverters INV1–INV3, and a switch circuit SW. The inverter INV3 has an inverting input control terminal. Upon receiving a low-level signal at the inverting input control terminal thereof, the inverter INV3 functions as an inverter. Upon receiving a high-level signal at the inverting input control terminal thereof, the inverter INV3 drives the output terminal to a high-impedance state. The inverters INV2 and INV3 function as a latch circuit when the scanning signal Y1 is at a low level (at a non-active level), and function as an inverter circuit when the scanning signal Y1 is at a high level.

The switch circuit SW receives the scanning signal Y1 at the control input terminal, while receiving the scanning signal Y1 at the inverting input control terminal thereof through the inverter INV1. When the scanning signal Y1 is at a high level, the switch circuit SW is turned on, and the common control signal SC is fed to the input terminal of the inverter INV2. When the scanning signal Y1 is at a low level, the switch circuit SW is turned off, and the common control signal SC is not fed to the input of the inverter INV2. The inverters INV2 and INV3 then function as a latch circuit, and the control signal SC1 remains unchanged from the immediately prior level.

FIG. 11 shows the truth table of the control circuit C1 in this arrangement. As is clear from the truth table, the control circuit C1 outputs the control signal SC1, specifically, outputs the common control signal SC in its inverted form when the scanning signal Y1 is driven to a high level, while maintaining the immediately prior state when the scanning signal Y1 is at a low level.

<2-4: Operation of the Liquid-Crystal Device>

The operation of the liquid-crystal device of the second embodiment is now discussed, referring to the drawings.

<2-4-1: Operation of the Liquid-Crystal Device When the Device Switches Between the Moving Picture and the Still Picture on a Field by Field Basis>

Figure 12:
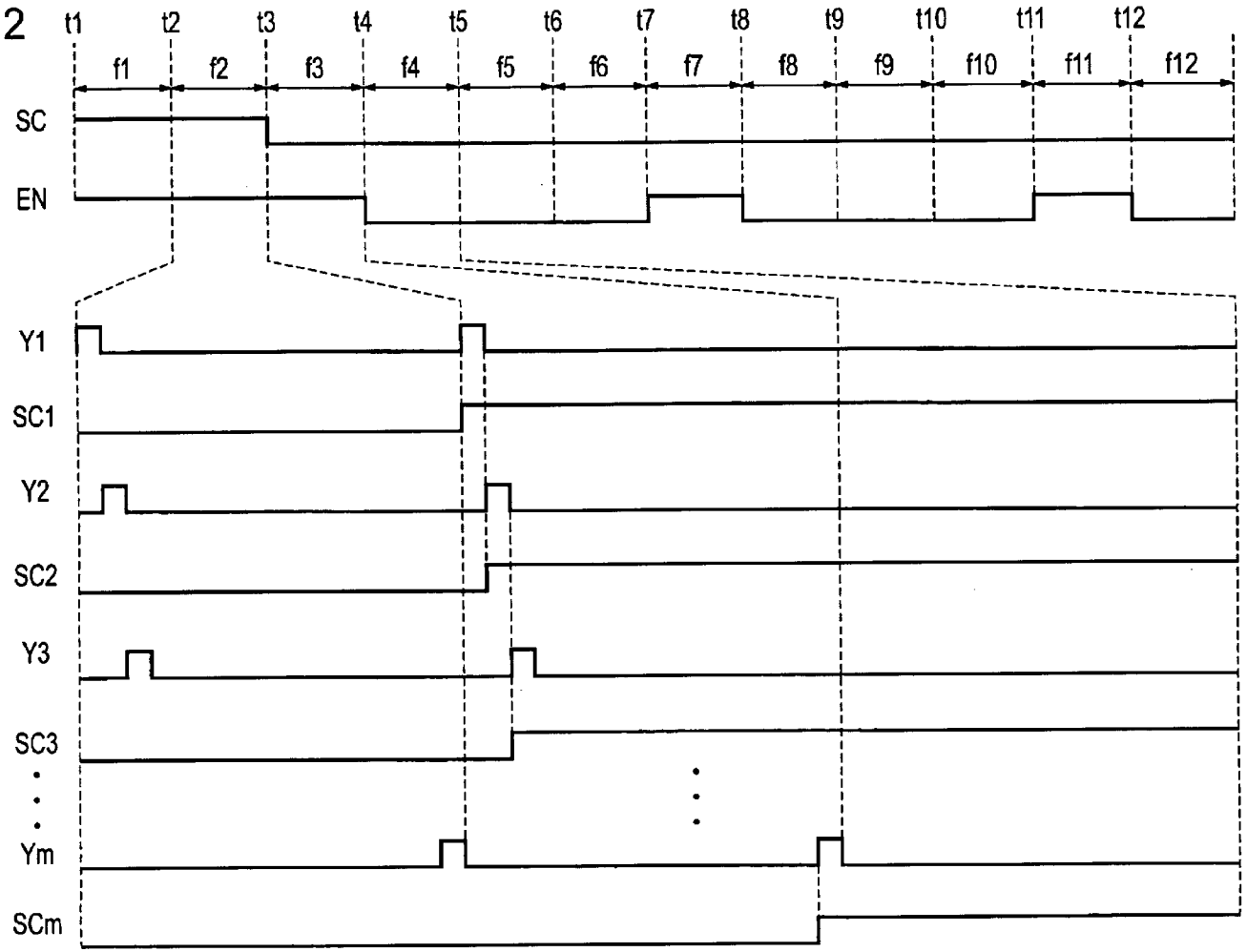
FIG. 12 is a timing diagram showing the operation of the control circuit.

The operation of the liquid-crystal device when the device switches between the moving picture and the still picture on an entire screen on a field by field basis will now be discussed. In this case, the moving picture is presented in a first field f1 and a second field f2. The still picture is presented in a third field f3 and subsequent fields. FIG. 12 is a timing diagram showing the operation of the liquid-crystal device. As shown, the still picture is presented in the third field and subsequent fields, and the common control signal SC is transitioned from a high level to a low level at time t3 at which the third field f3 starts. As already discussed in connection with the first embodiment with reference to FIG. 7, the common control signal SC is transitioned in level within the vertical blanking period of the third field. Similarly, the enable signal EN is transitioned in signal level within the vertical blanking period.

The enable signal EN is at a high level in the first field f1 and the second field f2 in the moving picture display periods. From the third field f3 thereafter, the enable signal EN is transitioned to a high level every fourth field.

In the second field f2, in the moving picture display period, the enable signal EN is at a high level, and the scanning signals Y1, Y2, . . . , Ym are successively driven high in level as in a normal operation. The scanning lines 3*a* are thus successively selected, and the data line signals X1-Xn are supplied to the pixels on a scanning line by scanning line basis. Since the common control signal SC is at a high level, the scanning signals SC1, SC2, . . . , SCm are at a low level. Throughout this period, the TFTs 51 are turned off, thereby disconnecting the storage capacitor 52 from the liquid-crystal capacitor LC. During the moving picture display period, the load viewed from the data line driving circuit 100 is light.

In the third field f3, as a first field within the still picture display period, the enable signal EN is at a high level. The scanning signals Y1, Y2, . . . , Ym are generated as in the moving picture display period. Throughout this period, the common control signal SC remains low. The control circuits C1, C2, . . . , Cm output the common control signal SC in its inverted form as already discussed above, when the scanning signals Y1, Y2, . . . , Ym are driven high. When the scanning signals Y1, Y2, . . . , Ym are driven low, the control circuits C1, C2, . . . , Cm maintains the prior states thereof. When the scanning signals Y1, Y2, . . . , Ym are transitioned from a low level to a high level in the third level f3 as shown in FIG. 12, the control signals SC1, SC2, . . . , SCm are transitioned to a high level in synchronization with the respective timings, and then maintain the states thereafter. In the first field for the still picture display period, the TFTs 51 are turned on, thereby connecting the storage capacitor 52 to the liquid-crystal capacitor LC, and voltage writing is performed on these capacitors.

In the fourth field f4, as a second field within the still picture display period, the enable signal EN remains low. The scanning signals Y1, Y2, . . . , Ym remains at a low level. No voltage is written on each pixel, and the control signals SC1, SC2, . . . , SCm maintain a high level, and the storage capacitor 52 remains connected to the liquid-crystal capacitor LC.

In the fifth field f5 and the sixth field f6, as the third field and the fourth field within the still picture display period, no voltage is written on the pixels in the same way as in the third field f3. The storage capacitor 52 remains connected to the liquid-crystal capacitor LC. The operation from the seventh field f7 to the tenth field f10 is identical to that from the third field f3 to the sixth field f6.

During the still picture display period, voltage writing is performed in one field out of the four fields, and the written voltage is maintained for the remaining three fields. Specifically, the field frequency during the still picture display period drops to one-fourth the field frequency during the moving picture display period. During the still picture display period, the storage capacitor 52 is connected to the liquid-crystal capacitor LC, and the voltage written on the pixel is well maintained. The number of writing operations performed on the pixel per unit time is smaller than the number of writing operations performed during the moving picture display period. Power consumption is thus reduced.

<2-4-2: Operation of the Device when the Moving Picture and the Still Picture are Concurrently Presented>

The operation for concurrently presenting both a moving picture and a still picture will now be discussed. When the number of scanning lines 3*a* is m (=2k, where k is a natural number), a moving picture is presented on the upper half of a screen formed of first through k-th scanning lines 3*a*, while a still picture is presented on the lower half of the screen formed of (k+1)-th through 2k-th scanning lines 3*a*.

Figure 13:
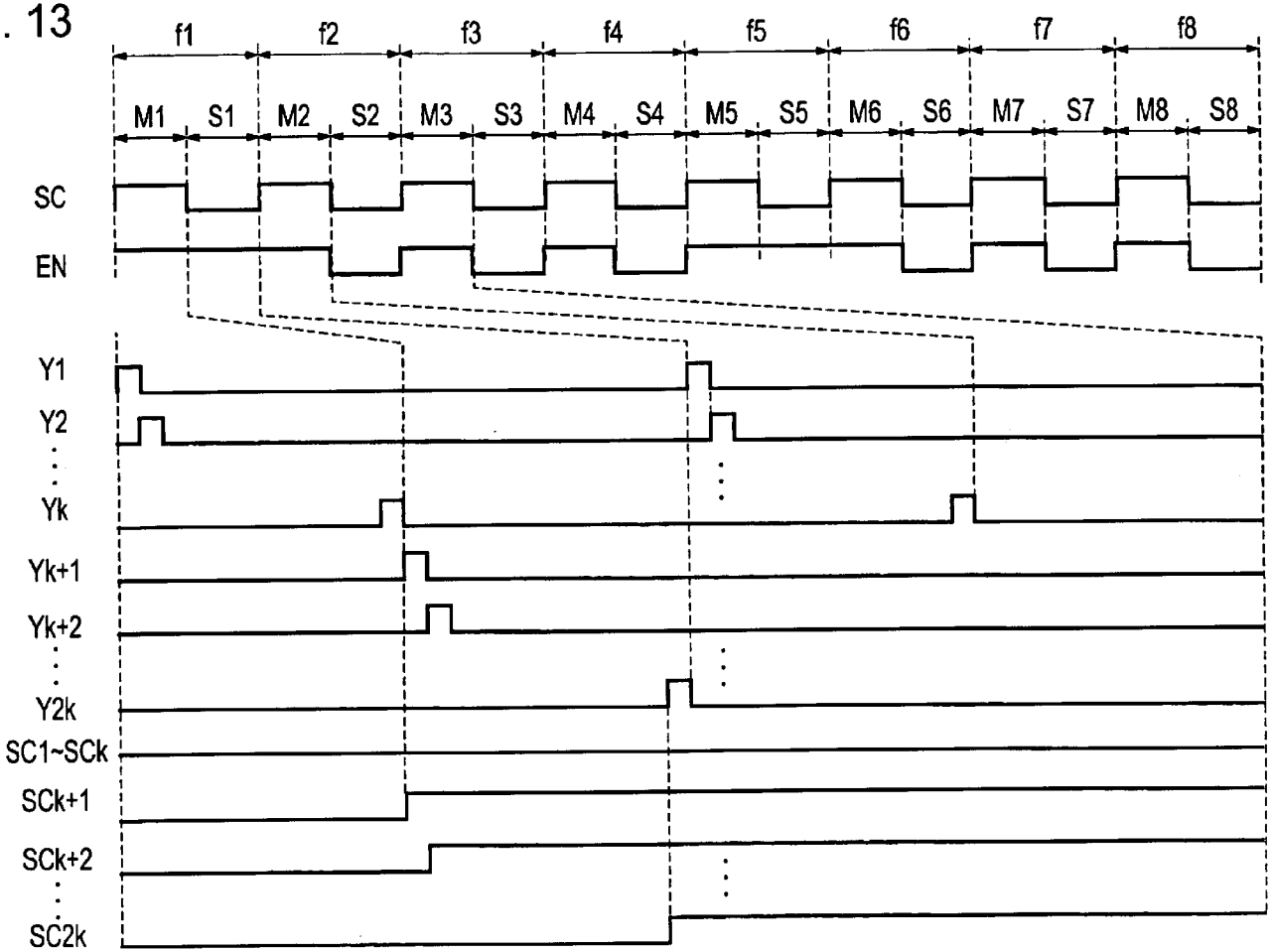
FIG. 13 is a timing diagram showing another operation of the control circuit.

FIG. 13 is a timing diagram showing the operation of the liquid-crystal device. As shown, in each of fields f1 through f8, first half durations of the respective fields are designated moving picture display periods M1–M8. The second half durations of the respective fields are designated still picture display periods S1–S8.

Since the moving picture is presented on the upper half of the screen with the still picture presented on the lower half screen, the common control signal SC is at a high level during each of the moving picture display periods M1–M8, and is at a low level during each of the still picture display periods S1–S8. In this example, the signal level of the common control signal SC is transitioned within a horizontal blanking period in each field.

Figure 14:
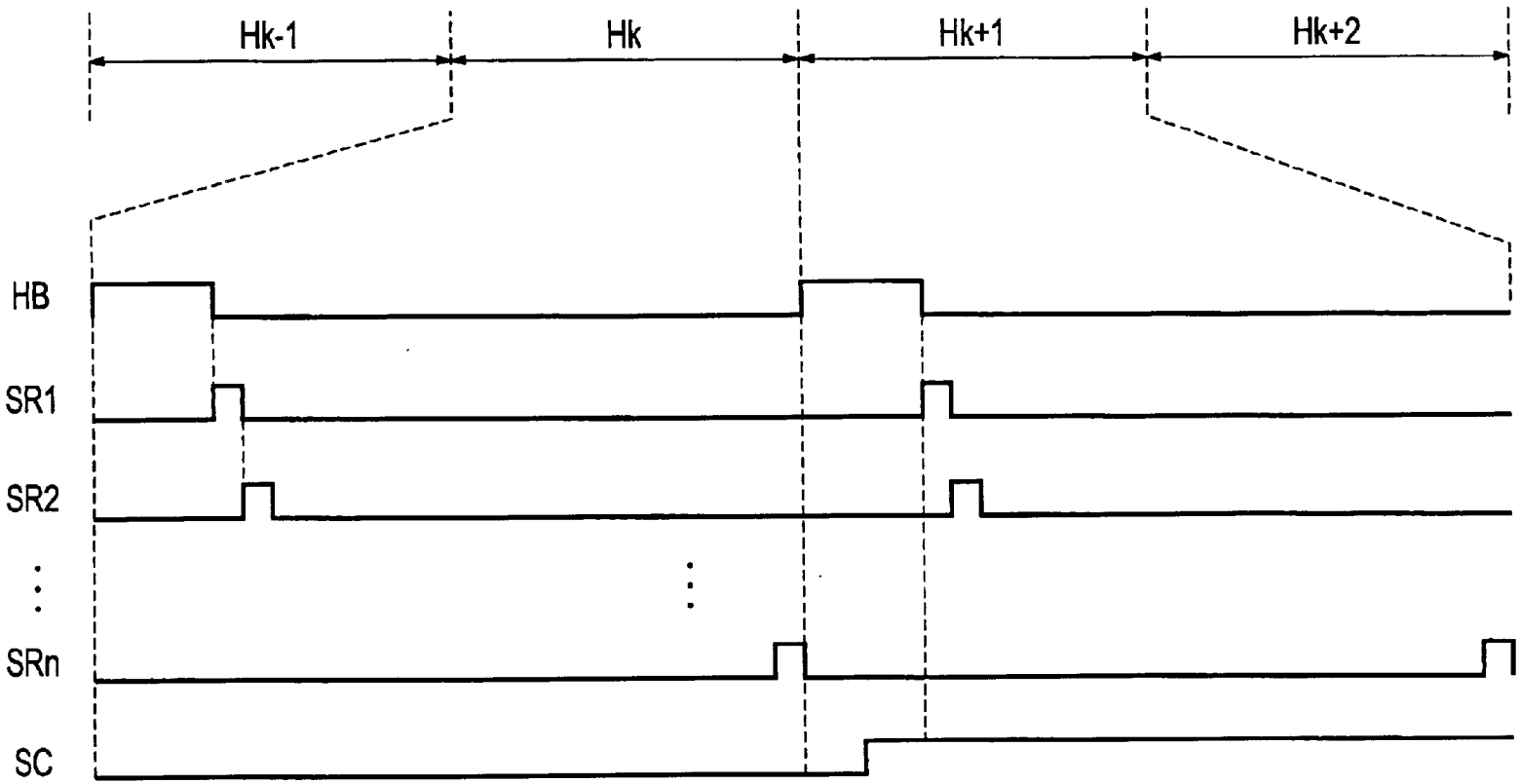
FIG. 14 is a timing diagram showing the switching timing of a common control signal in the liquid-crystal device.

FIG. 14 is a timing diagram showing the switching timing of the common control signal SC. As shown, a high-level duration of a horizontal blanking signal HB is the horizontal blanking period. The horizontal blanking signal HB is generated in the timing signal generator circuit 300B, and is used to generate X shift pulse DX, etc. The sampling pulses SR1, SR2, . . . , SRn successively become active (to a high level) while the horizontal blanking signal HB remains at a low level. The common control signal SC is transitioned from a low level to a high level within a horizontal blanking period of a (k+1)-th horizontal scanning period (Hk+1). In other words, the signal level of the common control signal SC is transitioned while all TFTs 50 remain turned off. While the data line signals X1, X2, . . . , Xn are written to the respective pixels, the control signal SC remains unchanged in level, and the connection and disconnection of the storage capacitor 52 to and from the liquid-crystal capacitor LC are not performed throughout this period. As a result, the data line signals X1, X2, . . . , Xn are reliably captured in the pixels. Image quality is not degraded at a switching timing at which the moving picture is switched to the still picture.

Returning to FIG. 13, the enable signal EN remains high in level during each of the moving picture display periods M1-M8. The scanning signals Y1, Y2, . . . , Yk are successively turned on throughout each of these periods. The enable signal EN remains at a high level during the still picture display periods S1 and S5, and remains at a low level during the still picture display periods S2–S4 and S6–S8. During the still picture display periods S1-S8, the enable signal EN takes a high level once every four periods, thereby transitioning as follows: a high level, a low level, a low level, a low level.

The operation of the device in the first field f1 and the second field f2 will now be discussed in more detail. During the moving picture display periods M1 and M2, the enable signal EN remains high in level and the scanning signals Y1, Y2, . . . , Yk are successively activated, thereby writing the data line signals X1–Xn to the respective pixels. In this case, the common control signal SC remains high in level, the control signals SC1–SCk are at a low level as shown, and the storage capacitor 52 remains unconnected. Voltage writing is thus performed on the liquid-crystal capacitor LC only in each of the pixels in the upper half screen.

During the still picture display period S1, the enable signal EN remains at a high level, and the scanning signals Y1, Y2, . . . , Yk are successively activated, thereby respectively writing the data line signals X1–Xn to the pixels in the same manner as during the moving picture display period M1. The common control signal SC remains low in level, and the control signals (SCk+1)–(SC2k) are driven high respectively in synchronization with the rising edges of the scanning signals Y1, Y2, . . . , Yk, thereby putting the storage capacitors 52 in the connected state. Voltage writing is thus performed on the liquid-crystal capacitor LC and the storage capacitor 52 in each of the pixels in the lower half screen.

During the still picture display period S2, the enable signal EN remains low in level. The scanning signals Y1, Y2, . . . , Yk remain low in level, and the data line signals X1–Xn are not written on the pixels. In other words, the still picture display period S2 is a holding period, throughout which the voltage written during the still picture display period S1 is maintained. Since the control signals (SCk+1)–(SC2k) are high in level, the storage capacitor 52 remains connected to the liquid-crystal capacitor LC.

During the still picture display periods S3 and S4, the enable signal EN is low in level in the same way as during the still picture display period S2. Each pixel in the lower half of the screen maintains the voltage thereof with the storage capacitor 52 remaining connected.

In the upper half screen where a moving picture is displayed, voltage writing is performed, with the storage capacitor 52 disconnected, on a field by field basis as in the normal operation. In the lower half screen where a still picture is displayed, voltage writing is performed, with the storage capacitor 52 connected, on a one-out-of-four field basis. As a result, in the still picture display area, voltage writing is performed in one out of four fields, and the written voltage is being held for the remaining three fields. In other words, the field frequency of the still picture display area has ¼ of the field frequency of the moving picture display area.

Since the storage capacitor 52 is connected to the liquid-crystal capacitor LC in the still picture display area, the voltage written on the pixel is well maintained, and the number writing operations performed on the pixel per unit time is smaller than the number of writing operations performed during the moving picture display period. Power consumption is thus reduced.

<3. Modifications>

<3-1: Construction of the Element Substrate>

In each of the above embodiments, the TFTs 51 and 52 forming a pixel are of an N-channel transistor. The present invention is not limited to the N-channel transistor. P-channel transistors may be used for the TFTs 51 and 52. In this case, the scanning signals Y1, Y2, . . . , Ym and the control signal SC are set to be active at the low level thereof. Alternatively, CMOS transistors may also be used.

In each of the above embodiments, the element substrate 151 in each of the liquid-crystal panels AA and BB is fabricated of a transparent insulator substrate, such as of glass. A thin silicon layer is deposited on the transparent insulator substrate. TFTs, with the source, the drain, and the channel formed in the thin silicon layer, work as a switching element (the TFT 50), and elements for the data line driving circuit 100, and the scanning line driving circuit 200. However, the invention is not limited to this arrangement.

For example, the element substrate 151 may be fabricated of a semiconductor substrate, and insulated gate EFTs having the source, the drain, and the channel formed on the surface of the semiconductor substrate, may be used as the switching element for each pixel and elements for various circuits. When the element substrate 151 is fabricated of a semiconductor substrate in this way, the element substrate 151 is used as a reflective-type with the pixel electrodes 9*a* formed of aluminum, because the element substrate cannot be used as a transmissive type panel. Alternatively, the element substrate 151 may be formed of a transparent substrate with the pixel electrodes 9*a* being reflective.

<3-2: Electronic Equipment>

Electronic equipment incorporating the above-referenced liquid-crystal device will now be discussed.

<3-2-1: Projector>

Figure 15:
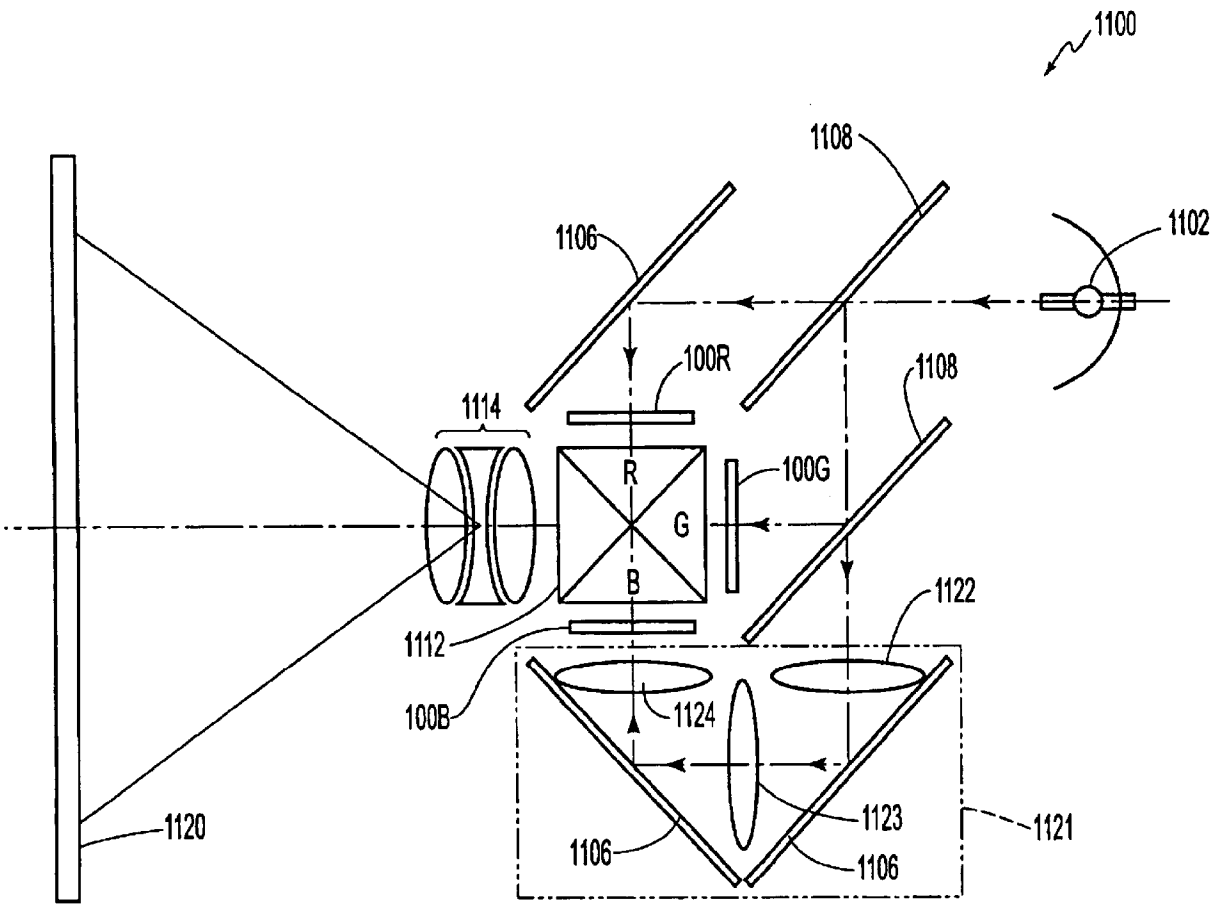
FIG. 15 is a cross-sectional view of a projector, which is one example of the electronic equipment incorporating the liquid-crystal device of the invention.

A projector incorporating the liquid-crystal panel AA as a light valve will now be discussed. FIG. 15 is a plan view showing the projector. As shown, the projector 1100 includes a lamp unit 1102 composed of a white light source such as a halogen lamp. A light beam from a lamp unit 1102 is separated into red, green, and blue color beams through three mirrors 1106 and two dichroic mirrors 1108. The three color light beams are then guided to respective light valves 100R, 100G, and 100B. The blue color beam travels along a path longer than those for the red and green color beams, and to prevent loss, the blue color beam is guided through a relay lens system 1121, composed of an incident lens 1122, a relay lens 1123, and an exit lens 1124.

The liquid-crystal panels 100R, 100G, and 100B have the same construction as that of the liquid-crystal panel AA, and are driven by the red, green, and blue color signals supplied from an image signal processor circuit (not shown). The red, green, and blue light beams, respectively color-modulated by the liquid-crystal panels 100R, 100G, and 100B, are incident on a dichroic prism 1112 in three directions. The red and blue color beams are refracted at 90° by the dichroic prism 1112, while the green color beam travels straight. The three color images are synthesized, and a synthesized color image is then projected by a projection lens 1114 onto a screen 1120.

Concerning the display images from the liquid-crystal panels 100R, 100B, and 100G, the display image from the liquid-crystal panel 100G needs to be laterally inverted with respect to the display images from the liquid-crystal panels 100R and 100B. Because of this, the horizontal scanning direction of the liquid-crystal panel 100G is opposite to the horizontal scanning direction of the liquid-crystal panels 100R and 100B. Since red, green, and blue light beams are respectively incident on the liquid-crystal panels 100R, 100B, and 100G through the dichroic mirrors 1108, no color filters are required.

<3-2-2: Mobile Computer>

Figure 16:
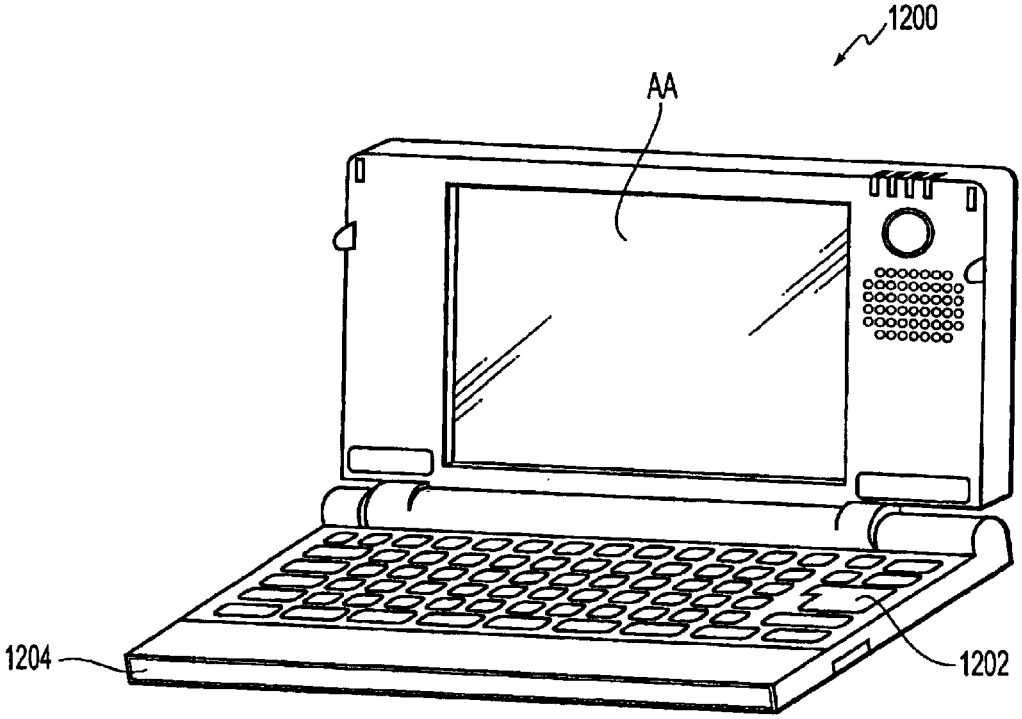
FIG. 16 is a perspective view of a mobile computer, which is another example of the electronic equipment incorporating the liquid-crystal of the invention.

Discussed here is a mobile computer incorporating the above-referenced liquid-crystal panel AA. FIG. 16 is a perspective view of the mobile computer. The computer 1200 includes a main unit 1204 having a keyboard 1202, and a display unit 1206. The display unit 1206 is composed of the above-referenced liquid-crystal panel AA with a back light attached on the back thereof.

<3-2-3: Mobile Telephone>

Figure 17:
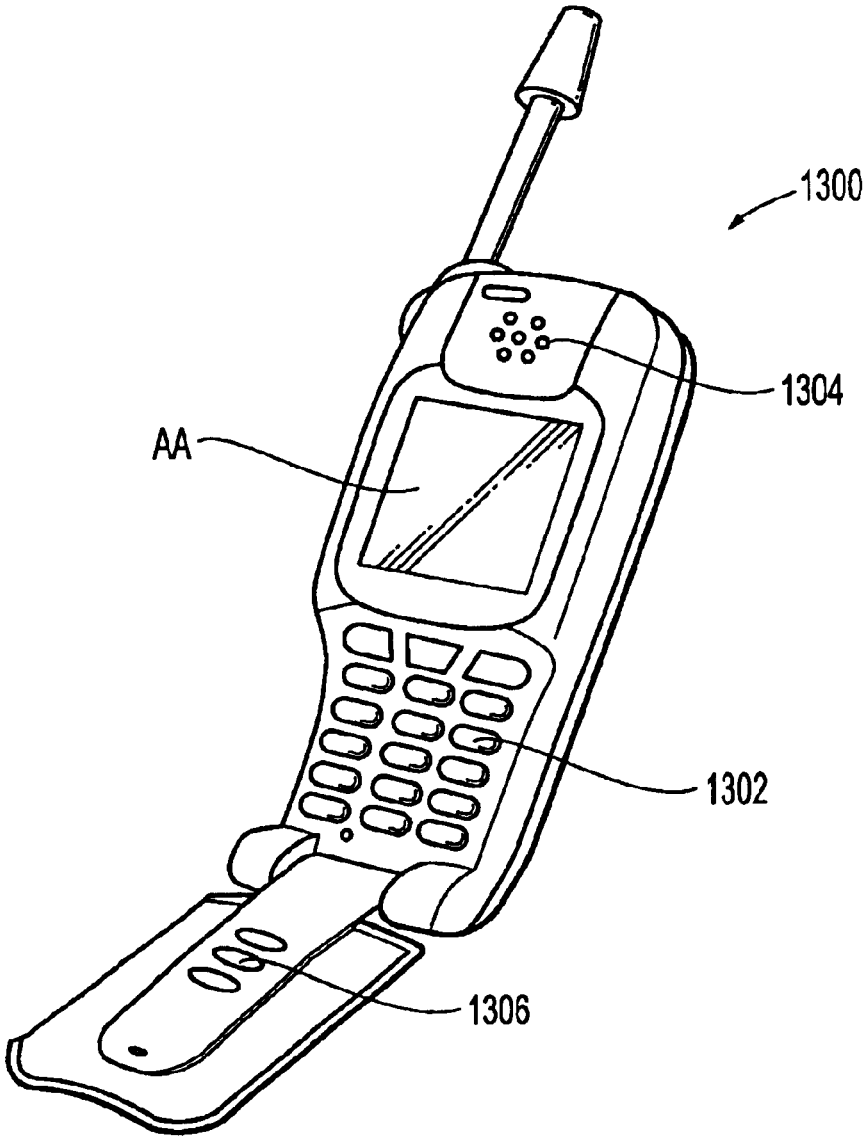
FIG. 17 is a perspective view of a mobile telephone, which is yet another example of the electronic equipment incorporating the liquid-crystal device of the invention.
Figure 18:
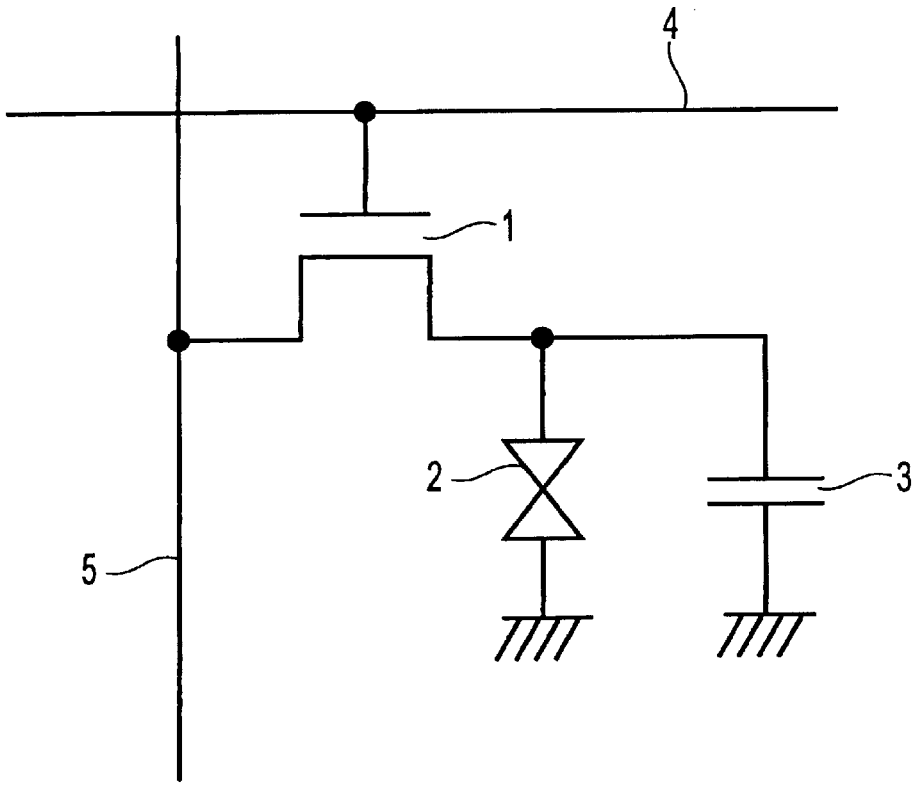
FIG. 18 RELATED ART
FIG. 18 is an equivalent circuit diagram showing a pixel used in a conventional electro-optical panel.

Discussed next is a mobile telephone incorporating the above-referenced liquid-crystal panel AA. FIG. 17 is a perspective view of the mobile telephone. As shown, the portable telephone 1300 includes a plurality of control buttons 1302, an earpiece 1304, a mouthpiece 1306, and the liquid-crystal panel AA. The liquid-crystal panel AA is provided with a back light on the back thereof as necessary.

Besides the electronic equipment described with reference to FIG. 15 through FIG. 17, the electronic equipment of the invention may be any of a diversity of known or later developed electronic equipment including a liquid-crystal display television, a viewfinder type or direct monitoring type video cassette recorder, a car navigation system, a pager, an electronic pocketbook, an electronic tabletop calculator, a word processor, a workstation, a video phone, a POS terminal, and an apparatus having a touch panel. These pieces of electronic equipment may incorporate the liquid-crystal panel of each of the above embodiments, and the electro-optical device.

[Advantages]

As described above, the invention reliably writes the voltage of the data line on the pixel by generating the control signal in accordance with the write period and the holding period, and maintains the written voltage in a sufficiently high level. In this way, even if the field frequency is dynamically changed, high image quality is maintained.

What is claimed is:

1. An electro-optical panel comprising:

a first substrate having a plurality of scanning lines and a plurality of data lines formed thereon;

a second substrate opposed to the first substrate, an electro-optical material interposed between the first substrate and the second substrate, and a control signal generator which generates a control signal in accordance with a field frequency to be supplied to each control line, in accordance with the scanning signal and a common control signal indicating whether an image to be displayed is a moving picture or a still picture, wherein;

the first substrate includes:

a plurality of control lines respectively formed corresponding to the scanning lines, a first switching element, which is arranged at each intersection of one of the scanning lines and one of the data lines, is controlled for an on and off operation in response to a scanning signal supplied through the scanning line, and is connected between the data line and a pixel electrode, and a second switching element, which is arranged at each intersection of one of the scanning lines and one of the data lines, is controlled for an on and off operation in response to the control signal supplied through the control line, and is connected between the pixel electrode and a storage capacitor, the control signal generator generates the control signal respectively corresponding to each control line, and supplies the control line with the respective control signal;

during an active period of the scanning signal, the control signal generator generates the control signal for turning off the second switching element when the common control signal indicates the moving picture and generates the control signal for turning on the second switching element when the common control signal indicates the still picture; and during a non-active period of the scanning signal, the control signal generator generates the control signal for holding the state of the second switching element during the active period immediately prior to this non-active period of the scanning signal.

2. The electro-optical panel according to claim 1, further comprising:

a first converter which converts input image data into point-at-a-time image data;

a second converter which converts the point-at-a-time image data into line-at-a-time image data;

a data line signal supplier which supplies each data line with a data line signal that is generated in accordance with the line-at-a-time image data; and a scanning line driver which generates a scanning signal for successively selecting the scanning lines and supplies the scanning lines with the scanning signal.

3. An electro-optical device comprising:

the electro-optical panel according to claim 1, and a control signal generator generating the control signal depending on whether an image to be displayed is a moving picture or a still picture.

4. An electro-optical panel comprising:

a first substrate having a plurality of scanning lines and a plurality of data lines formed thereon;

a second substrate opposed to the first substrate;

an electro-optical material interposed between the first substrate the second substrate; wherein:

the first substrate includes:

a plurality of control lines respectively formed corresponding to the scanning lines, a first switching element, which is arranged at each intersection of one of the scanning lines and one of the data lines, is controlled for an on and off operation in response to a scanning signal supplied through the scanning line, and is connected between the data line and a pixel electrode, a second switching element, which is arranged at each intersection of one of the scanning lines and one of the data lines, is controlled for an on and off operation in response to a control signal supplied through the control line, and is connected between the pixel electrode and a storage capacitor, and a plurality of control circuits generating the control signal, to be supplied to each control line, in accordance with the scanning signal and a common control signal indicating whether an image to be displayed is a moving picture or a still picture;

during an active period of the scanning signal, the control circuit generates the control signal for turning off the second switching element when the common control signal indicates the moving picture and generates the control signal for turning on the second switching element when the common control signal indicates the still picture; and during a non-active period of the scanning signal, the control circuit generates the control signal for holding the state of the second switching element during the active period immediately prior to this non-active period of the scanning signal.

5. The electro-optical panel according to claim 4, comprising:

a scanning line driver generating the scanning signal for successively selecting the scanning lines and supplies the scanning lines with the scanning signal for only a period during which an enable signal supplied from outside remains active.

6. The electro-optical panel according to claim 1, wherein the first switching element and the second switching element are thin-film transistors.

7. An electro-optical device which switches between a moving picture and a still picture on a field by field basis, the electro-optical device comprising:

the electro-optical device according to claim 5, a common control signal generator generating the common control signal which is a binary signal which transitions in level on a field by field basis for indicating a moving picture with one signal level thereof and a still picture with the other signal level thereof, depending on whether an image to be displayed is the moving picture or the still picture, and an enable signal generator generating the enable signal that alternates between an active period and a non-active period with a constant period, wherein the enable signal is active during a moving picture display period, while, during a still picture display period, the enable signal is active in a first field and becomes non-active in one field or a plurality of fields subsequent to the first field.

8. The electro-optical device according to claim 7, wherein the common control signal generator transitions the signal level of the common control signal within a vertical blanking period, and wherein the enable signal generator switches between the active period and the non-active period in the enable signal within the vertical blanking period.

9. An electro-optical device which switches between a moving picture and a still picture on a scanning line by scanning line basis, the electro-optical device comprising:

the electro-optical device according to claim 5, a common control signal generator generating the common control signal which is a binary signal which transitions in level for indicating a moving picture with one signal level thereof and a still picture with the other signal level thereof, depending on whether a moving picture display area is scanned during a moving picture display period or a still picture display area is scanned during a still picture display period, and an enable signal generator generating the enable signal that alternates between an active period and a non-active period with a constant period wherein the enable signal is active during the moving picture display period in each field, while, during the still picture display period, the enable signal is active in a first field and becomes non-active in one field or a plurality of fields subsequent to the first field.

10. The electro-optical device according to claim 9, wherein the common control signal generator transitions the signal level of the common control signal within one of a vertical blanking period and a horizontal blanking period, and wherein the enable signal generator switches between the active period and the non-active period in the enable signal during one of the vertical blanking period and the horizontal blanking period.

11. Electronic equipment comprising the electro-optical device according to claim 1.

* * * * *